US009610768B1

(12) United States Patent
Hosokawa et al.

(10) Patent No.: US 9,610,768 B1
(45) Date of Patent: Apr. 4, 2017

(54) LIQUID DISCHARGING APPARATUS AND DISCHARGE STATE DETERMINATION METHOD OF LIQUID IN LIQUID DISCHARGING APPARATUS

(71) Applicant: SEIKO EPSON CORPORATION, Tokyo (JP)

(72) Inventors: Yasuhiro Hosokawa, Nagano (JP); Masashi Kamiyanagi, Nagano (JP); Osamu Shinkawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/264,875

(22) Filed: Sep. 14, 2016

(30) Foreign Application Priority Data

Sep. 16, 2015 (JP) ..... 2015-183061

(51) Int. Cl.
*B41J 2/045* (2006.01)

(52) U.S. Cl.
CPC ..... *B41J 2/04541* (2013.01); *B41J 2/04586* (2013.01); *B41J 2/04588* (2013.01)

(58) Field of Classification Search
CPC ..... B41J 2/04588; B41J 2/04596; B41J 2/04598; B41J 2/04541; B41J 29/393; B41J 2/04586; B41J 2/04528; B41J 2/04571
See application file for complete search history.

(56) References Cited

U.S. PATENT DOCUMENTS

| | | | | |
|---|---|---|---|---|
| 7,150,513 | B2 | 12/2006 | Shinkawa et al. | |
| 7,159,976 | B2 | 1/2007 | Kawamura et al. | |
| 7,562,970 | B2 | 7/2009 | Okuda et al. | |
| 9,221,253 | B2 * | 12/2015 | Suzuki | B41J 2/04588 |

FOREIGN PATENT DOCUMENTS

| | | | |
|---|---|---|---|
| JP | 2003-096369 | A | 4/2003 |
| JP | 2004-276544 | A | 10/2004 |
| JP | 2007-196593 | A | 8/2007 |

* cited by examiner

*Primary Examiner* — Thinh H Nguyen
(74) *Attorney, Agent, or Firm* — Global IP Counselors, LLP

(57) ABSTRACT

A liquid discharging apparatus includes a first discharge section that discharges a pigment ink, a second discharge section that discharges a dye ink, a detection section that detects residual vibrations that occur in the first discharge section and outputs a first detection signal, which shows a corresponding detection result, and detects residual vibrations that occur in the second discharge section and outputs a second detection signal, which shows a corresponding detection result, and a determination section that executes a first determination, which determines whether or not the first detection signal satisfies first conditions, which should be satisfied in a case in which a discharge state of the first discharge section is normal, and executes a second determination, which determines whether or not the second detection signal satisfies second conditions, which should be satisfied in a case in which a discharge state of the second discharge section is normal.

8 Claims, 18 Drawing Sheets

EXPERIMENTAL VALUES AND CALCULATED VALUES OF RESIDUAL VIBRATIONS (AIR BUBBLE)

EXPERIMENTAL VALUES AND CALCULATED VALUES OF RESIDUAL VIBRATIONS (DRYING)

EXPERIMENTAL VALUES AND CALCULATED VALUES OF RESIDUAL VIBRATIONS (PAPER DUST)

FIG. 15

| DESIGNATION CONTENT OF SI[m] | SI[m] (b1, b2, b3) | TSx | | | TSy | | |
|---|---|---|---|---|---|---|---|
| | | Sa[m] | Sb[m] | Sc[m] | Sa[m] | Sb[m] | Sc[m] |
| LARGE DOT | (1, 1, 0) | H | L | L | H | L | L |
| MEDIUM DOT | (1, 0, 0) | H | L | L | L | H | L |
| SMALL DOT | (0, 1, 0) | L | H | L | H | L | L |
| NO RECORDING | (0, 0, 0) | L | H | L | L | H | L |
| DETERMINATION TARGET | (0, 0, 1) | L | L | H | L | L | H |

FIG. 20

| Flag | Tc (COMPARISON CONTENT) | Rs |
|---|---|---|
| 1 | Tc<TL | 2: DISCHARGE ABNORMALITY (AIR BUBBLE) |
| | TL≤Tc≤TH | 1: NORMAL |
| | TH<Tc≤THH | 3: DISCHARGE ABNORMALITY (FOREIGN MATTER) |
| | THH<Tc | 4: DISCHARGE ABNORMALITY (THICKENING) |
| 0 | N/A | 5: DISCHARGE ABNORMALITY |

LIQUID DISCHARGING APPARATUS AND DISCHARGE STATE DETERMINATION METHOD OF LIQUID IN LIQUID DISCHARGING APPARATUS

This application claims priority to Japanese Patent Application No. 2015-183061 filed on Sep. 16, 2015. The entire disclosure of Japanese Patent Application No. 2015-183061 is hereby incorporated herein by reference.

BACKGROUND

1. Technical Field

The present invention relates to a liquid discharging apparatus and a discharge state determination method of liquid in a liquid discharging apparatus.

2. Related Art

A liquid discharging apparatus such as an ink jet printer executes a printing process by forming images on a recording medium by discharging a liquid such as an ink, with which a cavity (a pressure chamber) of a discharge section is filled, as a result of displacing a piezoelectric element provided in the discharge section due to driving the piezoelectric element using a driving signal.

In this kind of liquid discharging apparatus, there are cases in which a printing process is performed using a pigment ink and a dye ink. For example, JP-A-2007-196593 proposes a technique that executes a printing process by adopting a pigment ink that is suited to text character printing, as a black ink, and adopting a dye ink that is suited to the printing of a clear color image, as a color ink. In addition, JP-A-2003-096369 discloses a printing process in which a pigment ink and a dye ink are used in combination.

Given that, in a liquid discharging apparatus, there are cases in which a discharge abnormality, in which it is no longer possible to normally discharge a liquid from a discharge section, occurs as a result of thickening of the liquid inside a cavity, the incorporation of an air bubble in the cavity, or the like. Further, when a discharge abnormality occurs, it is no longer possible to correctly form intended dots, which are formed on a recording medium by a liquid that is discharged from a discharge section, and therefore, the image quality of an image that the liquid discharging apparatus forms on the recording medium, is reduced.

In JP-A-2004-276544, a technique that prevents a reduction in image quality due to a discharge abnormality by detecting residual vibrations that occur in a discharge section after displacing a piezoelectric element through driving thereof using a driving signal, and determining a discharge state of a liquid in the discharge section on the basis of the characteristics of the residual vibrations such as the period length and amplitude of the residual vibrations, is proposed.

In a case in which a liquid discharging apparatus is capable of executing a printing process using a plurality of types of ink, and in particular, in a case in which a liquid discharging apparatus is capable of discharging a pigment ink and a dye ink in the manner disclosed in JP-A-2007-196593 and JP-A-2003-096369, the characteristics of residual vibrations that occur in a discharge section that discharges a pigment ink, and the characteristics of residual vibrations that occur in a discharge section that discharges a dye ink differ. Therefore, in a case in which the type of ink that each discharge section is filled with is not taken into consideration, there is a problem in that the accuracy of determination of the discharge state of liquid in a discharge section, is reduced.

SUMMARY

An advantage of some aspects of the invention is to provide a technique that determines discharge states in a liquid discharging apparatus that is capable of discharging a pigment ink and a dye ink, with high accuracy.

According to an aspect of the invention, there is provided a liquid discharging apparatus including a first discharge section that discharges a pigment ink, a second discharge section that discharges a dye ink, a supply section that supplies a first driving signal, which drives the first discharge section, to the first discharge section, and supplies a second driving signal, which drives the second discharge section, to the second discharge section, a detection section that detects residual vibrations that occur in the first discharge section when the supply section supplies the first driving signal, which includes a first detection waveform, to the first discharge section, and outputs a first detection signal, which shows a corresponding detection result, and detects residual vibrations that occur in the second discharge section when the supply section supplies the second driving signal, which includes a second detection waveform, to the second discharge section, and outputs a second detection signal, which shows a corresponding detection result and a determination section that executes a first determination, which determines whether or not the first detection signal satisfies first conditions, which should be satisfied in a case in which a discharge state of the first discharge section is normal, and executes a second determination, which determines whether or not the second detection signal satisfies second conditions, which should be satisfied in a case in which a discharge state of the second discharge section is normal.

In this case, since it is possible to respectively establish determination criteria of the discharge state for the first discharge section, which discharges a pigment ink, and the second discharge section, which discharges a dye ink, in an individual manner, it is possible to perform accurate determination of the discharge state using determination criteria that depend on the characteristics of an ink with which a discharge section is filled.

In the liquid discharging apparatus, the viscosity of the dye ink may be greater than that of the pigment ink, the first conditions may include a condition that the period length of the first detection signal is a first reference period or more, the second conditions may include a condition that the period length of the second detection signal is a second reference period or more, and the first reference period may be shorter than the second reference period.

In a case in which the viscosity of the dye ink is greater than that of the pigment ink, there is a high probability that the period length of the residual vibrations that occur in the first discharge section, which discharges the pigment ink, becomes shorter than that of the residual vibrations that occur in the second discharge section, which discharges the dye ink. In this case, since the discharge state is determined using determination criteria that take into consideration the fact that there is a high probability that the period length of the residual vibrations that occur in the first discharge section becomes shorter than that of the residual vibrations that occur in the second discharge section, it is possible to perform accurate determination of the discharge state.

In the liquid discharging apparatus, the first conditions may include a condition that the period length of the first detection signal is a third reference period or less, the second conditions may include a condition that the period length of the second detection signal is a fourth reference period or less, and the third reference period may be shorter than the fourth reference period.

In this case, since the discharge state is determined using determination criteria that take into consideration the fact that there is a high probability that the period length of the residual vibrations that occur in the first discharge section becomes shorter than that of the residual vibrations that occur in the second discharge section, it is possible to perform accurate determination of the discharge state.

In the liquid discharging apparatus, a value of a difference between the third reference period and the first reference period may be smaller than a value of a difference between the fourth reference period and the second reference period.

In this case, since the discharge state is determined using determination criteria that take into consideration the fact that a range of the period lengths of the residual vibrations that occur in the first discharge section in a case in which the discharge state of the first discharge section is normal is more narrow than a range of the period lengths of the residual vibrations that occur in the second discharge section in a case in which the discharge state of the second discharge section is normal, it is possible to perform accurate determination of the discharge state.

In the liquid discharging apparatus, the first detection waveform and the second detection waveform may be waveforms having different shapes.

In this case, since it is possible to control the amplitude of the residual vibrations that occur in first discharge section and the amplitude of the residual vibrations that occur in second discharge section depending on the viscosity of the pigment ink and the dye ink, the accuracy of the detection of residual vibrations is improved and therefore, it is possible to perform accurate determination of the discharge state.

In the liquid discharging apparatus, the viscosity of the dye ink may be greater than that of the pigment ink, and the amplitude of the second detection waveform may be greater than the amplitude of the first detection waveform.

In a case in which the viscosity of the dye ink is greater than that of the pigment ink, there is a high probability that the amplitude of the residual vibrations that occur in the first discharge section, which discharges the pigment ink, becomes greater than that of the residual vibrations that occur in the second discharge section, which discharges the dye ink.

In this case, since the amplitude of the second detection waveform is set to be greater than the amplitude of the first detection waveform, it is possible to set a ratio of the amplitude of the residual vibrations that occur in second discharge section with respect to the amplitude of the residual vibrations that occur in first discharge section to be larger than that in a case in which the amplitude of the second detection waveform is smaller than the amplitude of the first detection waveform. As a result of this, the accuracy of the detection of the residual vibrations that occur in the second discharge section is improved, and therefore, it is possible to determine the discharge state in the second discharge section with high accuracy.

In the liquid discharging apparatus, the viscosity of the dye ink may be greater than that of the pigment ink, the determination section may amplify the first detection signal by a first amplification factor in a case of executing the first determination, and may amplify the second detection signal by a second amplification factor in a case of executing the second determination, and the second amplification factor may be greater than the first amplification factor.

In a case in which the viscosity of the dye ink is greater than that of the pigment ink, there is a high probability that the amplitude of the residual vibrations that occur in the first discharge section, which discharges the pigment ink, becomes greater than that of the residual vibrations that occur in the second discharge section, which discharges the dye ink.

In this case, since the amplification factor of the second detection signal is set to be greater than the amplification factor of the first detection signal, even in a case in which the amplitude of the residual vibrations that occur in the second discharge section is small, the accuracy of the detection of the residual vibrations is improved, and therefore, it is possible to perform accurate determination of the discharge state.

According to another aspect of the invention, there is provided a discharge state determination method in a liquid discharging apparatus including a first discharge section that discharges a pigment ink, a second discharge section that discharges a dye ink, a supply section that supplies a first driving signal, which drives the first discharge section, to the first discharge section, and supplies a second driving signal, which drives the second discharge section, to the second discharge section, and a detection section that detects residual vibrations that occur in the first discharge section when the supply section supplies the first driving signal, which includes a first detection waveform, to the first discharge section, and outputs a first detection signal, which shows a corresponding detection result, and detects residual vibrations that occur in the second discharge section when the supply section supplies the second driving signal, which includes a second detection waveform, to the second discharge section, and outputs a second detection signal, which shows a corresponding detection result, the method including determining whether or not the first detection signal satisfies first conditions, which should be satisfied in a case in which a discharge state of the first discharge section is normal, and determining whether or not the second detection signal satisfies second conditions, which should be satisfied in a case in which a discharge state of the second discharge section is normal.

In this case, since it is possible to respectively establish determination criteria of the discharge state for the first discharge section, which discharges a pigment ink, and the second discharge section, which discharges a dye ink, in an individual manner, it is possible to perform accurate determination of the discharge state using determination criteria that depend on the characteristics of an ink with which a discharge section is filled.

BRIEF DESCRIPTION OF THE DRAWINGS

The invention will be described with reference to the accompanying drawings, wherein like numbers reference like elements.

FIG. 15 is an explanatory drawing that shows decoding contents of a decoder.

FIG. 20 is an explanatory diagram for describing determination information.

DESCRIPTION OF EXEMPLARY EMBODIMENTS

Hereinafter, aspects for implementing the invention will be described with reference to the drawings. However, in each figure, the dimensions and scales of each part have been altered from practical dimensions and scales as appropriate. In addition, since the embodiment that is mentioned below is a preferred specific example of the invention, various technically preferable limitations have been applied thereto, but the scope of the invention is not limited to these embodiments unless a feature that specifically limits the invention is disclosed in the following description.

A. EMBODIMENT

In the present embodiment, a liquid discharging apparatus will be described by illustrating an ink jet printer that forms images on recording sheets P (an example of a "medium") by discharging ink (an example of a "liquid"), by way of example.

1. Outline of Ink Jet Printer

The configuration of an ink jet printer 1 according to the present embodiment will be described with reference to FIGS. 1 and 2.

Figure 1:
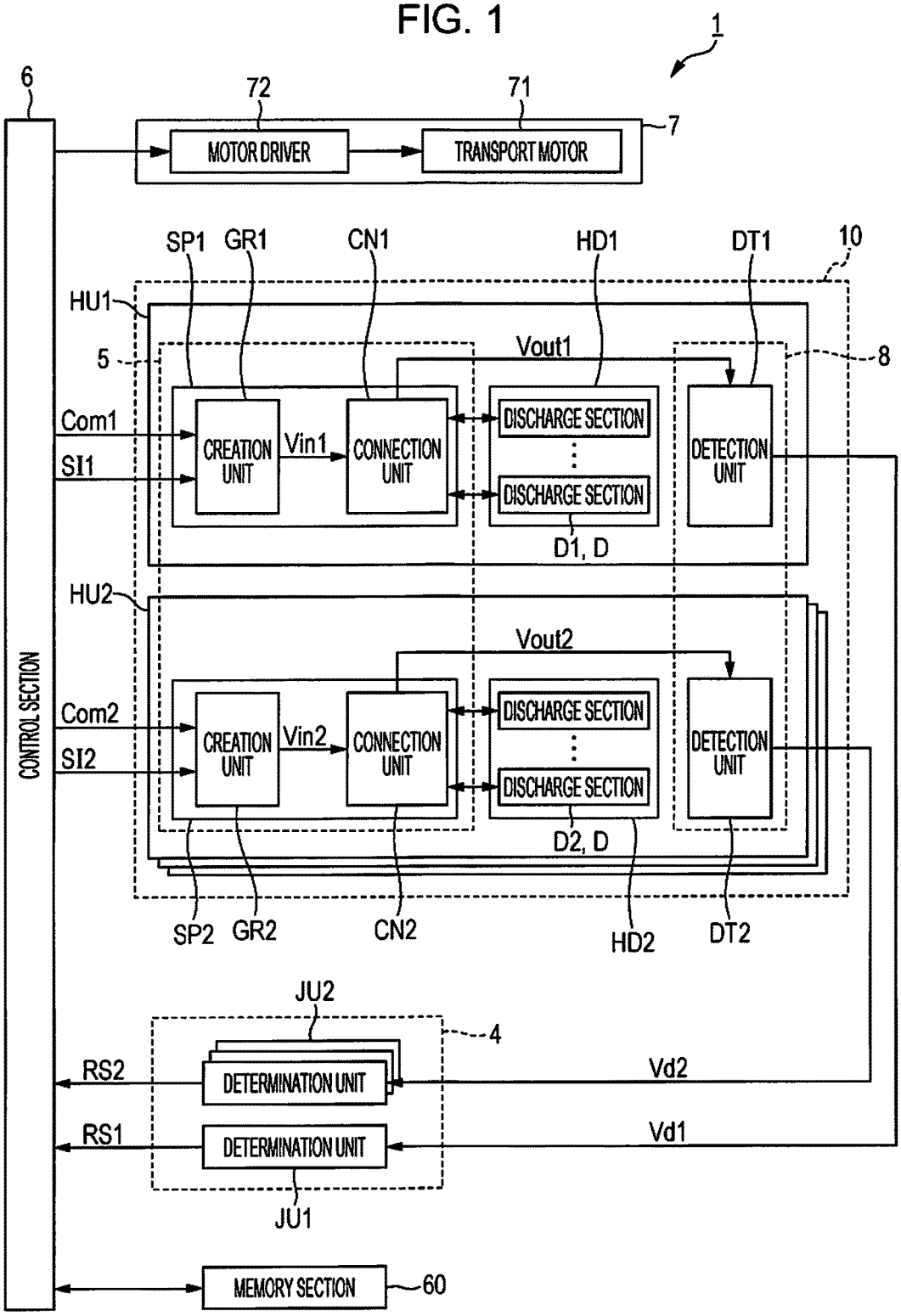
FIG. 1 is a block diagram that shows a configuration of an ink jet printer according to an embodiment of the invention.

FIG. 1 is a block diagram that shows a configuration of the ink jet printer 1 according to the present embodiment.

Printing data Img, which shows images that the ink jet printer 1 should form, and information, which shows a printing copy number of images that the ink jet printer 1 should form, are supplied to the ink jet printer 1 from a host computer (not illustrated in the drawings) such as a personal computer, a digital camera, or the like.

The ink jet printer 1 executes a printing process that forms images, which are shown by the printing data Img supplied from the host computer, on the recording sheets P. Additionally, in the present embodiment, description will be given illustrating a case in which the ink jet printer 1 is a line printer, by way of example.

As shown in FIG. 1, the ink jet printer 1 is provided with a head module 10, in which discharge sections D that discharge ink, are provided, a determination module 4 (an example of a "determination section") that determines discharge states of the ink in the discharge sections D, a transport mechanism 7 for changing a relative position of the recording sheets P with respect to the head module 10, a control section 6 that controls the actions of each section of the ink jet printer 1, a memory section 60 that stores a control program, other information, and the like of the ink jet printer 1, a maintenance mechanism (not illustrated in the drawings) that executes a maintenance process, which restores the discharge state of the ink in a discharge section D to normal in a case in which the occurrence of a discharge abnormality in the corresponding discharge sections D is detected, a display section that is configured by a liquid crystal display, an LED lamp or the like, and displays error messages, and the like, and a display operation section (not illustrated in the drawings), in which an operation section for a user of the ink jet printer 1 to input various commands, and the like, into the ink jet printer 1, is installed.

Figure 2:
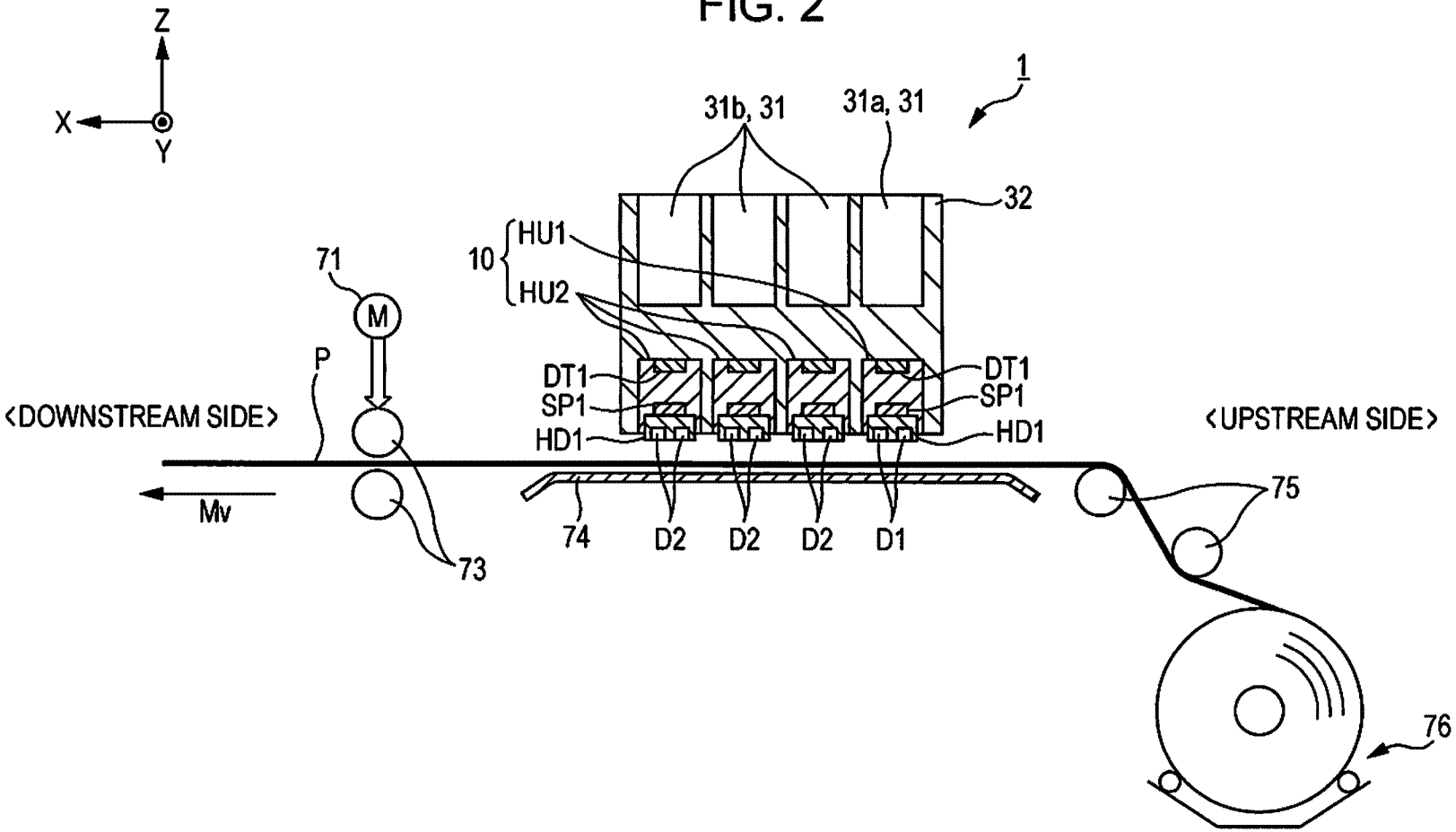
FIG. 2 is a schematic partial cross-sectional view of the ink jet printer.

FIG. 2 is a partial cross-sectional view that illustrates a schematic of an internal configuration of the ink jet printer 1 by way of example.

As shown in FIG. 2, the ink jet printer 1 is provided with a storage module 32, which stores the head module 10. In addition to the head module 10, four ink cartridges 31 are stored in the storage module 32. The four ink cartridges 31 provided to correspond on a one-to-one basis to four colors (CMYK) of ink of cyan ink, magenta ink, and yellow ink, which are three colors of chromatic color ink, and black ink, which is a single color of achromatic color ink.

In the present embodiment, a pigment ink, in which a pigment is configured as a color material, is used as black ink, and dye inks, in which dyes are configured as color materials, are used as the three chromatic color inks.

In addition, in the present embodiment, the viscosities of the dye inks are adjusted so as to be higher than the viscosity of the pigment ink. For example, in the manner disclosed in JP-A-2003-096369, a ratio of the viscosity of the dye inks with respect to the viscosity of the pigment ink (in other words, "(viscosity of dye ink)/(viscosity of pigment ink)") may be set to 1.3 or more. Additionally, the specific adjustment of the viscosities of the inks may be performed with a publicly-known method using the type and amount of a solvent, a dispersant, and a viscosity modifier that are included in the inks. For example, in this manner, disclosed in JP-A-2007-196593, in a case in which an ink includes a mixed solvent of water and a water-soluble organic solvent such as glycerin, as a solvent, the viscosity of the ink may be adjusted by adjusting the blending quantity of the water and the water-soluble organic solvent that are included as a solvent.

Hereinafter, among the four ink cartridges 31, an ink cartridge 31 that stores the pigment ink will be referred to as an ink cartridge 31*a*, and ink cartridges 31 that store the dye ink will be referred to as ink cartridges 31*b*. That is, the ink jet printer 1 according to the present embodiment includes a single ink cartridge 31*a*, which stores black ink, and three ink cartridges 31*b* for respectively storing cyan ink, magenta ink and yellow ink.

Additionally, instead of being stored in the storage module 32, the four ink cartridges 31 may be provided in a separate site of the ink jet printer 1.

As shown in FIG. 2, the head module 10 according to the present embodiment is configured to include a single head unit for pigment ink HU1 (hereinafter, simply referred to as a "head unit HU1"), which is provided to correspond to the single ink cartridge 31*a*, and three head units for dye ink HU2 (hereinafter, simply referred to as "head units HU2"), which are provided to correspond to the three ink cartridges 31*b* on a one-to-one basis. Hereinafter, the head unit HU1 and the head units HU2 will be collectively referred to as head units HU in cases in which it is not necessary to discriminate therebetween. That is, the head module 10 according to the present embodiment is provided with four head units HU to correspond to the four ink cartridges 31 on a one-to-one basis. Additionally, in FIG. 1, for convenience of illustration, the three head units HU2, which are provided in the head module 10, are displayed in a stacked manner (only a single head unit HU2 is displayed).

As shown in FIG. 1, the determination module 4 according to the present embodiment is configured to include a single determination unit Jill, which is provided to correspond to the single head unit HU1, and three determination units JU2, which are provided to correspond to the three head units HU2 on a one-to-one basis. Hereinafter, the determination unit JU1 and the determination units JU2 will be collectively referred to as determination units JU in cases in which it is not necessary to discriminate therebetween. That is, the determination module 4 according to the present embodiment is provided with four determination units JU to correspond to the four ink cartridges 31 on a one-to-one basis.

As shown in FIG. 1, the transport mechanism 7 is provided with a transport motor 71, which corresponds to a driving source for transporting the recording sheets P, and a motor driver 72 for driving the transport motor 71. In addition, as shown in FIG. 2, the transport mechanism 7 is provided with a platen 74 that is provided on a lower side (a −Z direction in FIG. 2) of the storage module 32, transport rollers 73 that rotate as a result of the action of the transport motor 71, guide rollers 75 that are provided so as to be capable of freely rotating around a Y axis in FIG. 2, and an accommodation section 76 for accommodating the recording sheets P in a state of being wound up in roll form. In a case in which the ink jet printer 1 executes a printing process, the transport mechanism 7 feeds out the recording sheets P from the accommodation section 76, and transports the recording sheets P in a direction from an upstream side toward a downstream side along a transport pathway that is defined by the guide rollers 75, the platen 74 and the transport rollers 73 at a transport speed Mv, for example.

Additionally, hereinafter, as shown in FIG. 2, a direction from the upstream side of the transport pathway toward the downstream side will be referred to as a +X direction, and a direction from the downstream side to the upstream side will be referred to as a −X direction. In addition, hereinafter, there are cases in which the +X direction and the −X direction will be collectively referred to as an X axis direction.

The memory section 60 is provided with EEPROM (Electrically Erasable Programmable Read-Only Memory), which is a type of non-volatile semiconductor memory that stores the printing data Img, which is supplied from the host computer, RAM (Random Access Memory) that temporarily stores data that is required when executing various processes such as the printing process, or temporarily develops a control program for executing various process such as the printing process, and PROM, which is a type of non-volatile semiconductor memory that stores a control program for controlling each section of the ink jet printer 1.

The control section 6 is configured to include a CPU (Central Processing Unit), an FPGA (field-programmable gate array) and the like, and the CPU controls the actions of each section of the ink jet printer 1 by acting in accordance with the control program stored in the memory section 60.

Further, the control section 6 controls the execution of a printing process, which forms images that depend on the printing data Img on the recording sheets P, by controlling the head module 10 and the transport mechanism 7 on the basis of the printing data Img that is supplied from the host computer, and the like.

More specifically, firstly, the control section 6 stores the printing data Img, which is supplied from the host computer, in the memory section 60.

Next, the control section 6 creates signals such as a printing signal SI, and a driving waveform signal Com, and the like for driving the discharge sections D by controlling the actions of the head module 10 on the basis of various data such as the printing data Img that is stored in the memory section 60.

In addition, the control section 6 creates a signal for controlling the actions of the motor driver 72 on the basis of the printing signal SI and various data that is stored in the memory section 60, and outputs the various created signals. Additionally, although described in more detail later, the driving waveform signal Com according to the present embodiment includes driving waveform signals Com-A, Com-B and Com-C.

Additionally, the driving waveform signal Com is an analog signal. Therefore, the control section 6 includes a DA conversion circuit, which is not illustrated in the drawings, and outputs a digital driving waveform signal, which is created in the CPU, or the like, that the control section 6 is provided with, after conversion into an analog driving waveform signal Com.

In this manner, the control section 6 transports the recording sheets P in the +X direction using the control of the transport mechanism 7, and, in addition, controls the presence or absence of the discharge of ink from the discharge sections D, an ink discharge amount, the discharge timing of ink, and the like, using the control of the head module 10. As a result of this, the control section 6 adjusts a dot size and dot disposition that is formed by ink that is discharged onto the recording sheets P, and controls each section of the ink jet printer 1 in a manner in which the printing process that forms images, which correspond to the printing data Img on the recording sheets P, is executed.

Additionally, in cases in which it is particularly necessary to discriminate therebetween, among the printing signal SI and the driving waveform signal Com that are supplied to the head module 10, signals that are supplied to the head unit HU1 will be referred to as a printing signal SI1 and a driving waveform signal Com1 and signals that are supplied to the head units HU2 will be referred to as printing signals SI2 and driving waveform signals Com2. In addition, the signals that are included in the driving waveform signal Com1 will be referred to as driving waveform signals Com-A1, Com-B1 and Com-C1, and the signals that are included in the driving waveform signal Com2 will be referred to as driving waveform signals Com-A2, Com-B2 and Com-C2.

Although described in more detail later, the control section 6 controls the actions of each section of the ink jet printer 1 in a manner in which a discharge state determination process, which determines whether or not the discharge state of the ink from each discharge section D is normal, that is, whether or not there is a discharge abnormality in each discharge section D.

In this instance, a discharge abnormality refers to a state in which the discharge state of the ink in the discharge sections D is abnormal, or in other words, a state in which it is not possible to correctly discharge the ink from the nozzles N (refer to FIGS. 3 and 4, which will be described later), which are installed in the discharge sections D. More specifically, discharge abnormalities include a state in which the discharge sections D cannot discharge the ink, a state in which the discharge sections D cannot discharge an amount of the ink that is required in order to form an image, which is shown by the printing data Img, as a result of a discharge amount of ink being small even in a case in which it is possible to discharge the ink from the discharge sections D, a state in which an amount of the ink that is required in order to form an image, which is shown by the printing data Img, or more is discharged from the discharge sections D, a state in which the ink, which is discharged from the discharge sections D, lands in a position that differs from a predetermined landing position in order to form an image, which is shown by the printing data Img, and the like.

In a case in which a discharge abnormality occurs in a discharge section D, the discharge state of ink in the corresponding discharge section D is restored to normal as a result of the maintenance mechanism executing a maintenance process. In this instance, the maintenance process is a process that returns the discharge state of the ink in a discharge section D to normal after newly supplying ink to the discharge section D from the ink cartridges 31 by ejecting the ink inside the corresponding discharge section D, and examples of such a process include a flushing process that performs preliminary discharge of the ink from a discharge section D, a pumping process that suctions ink, air bubbles, or the like, which has thickened inside the discharge section D, using a tube pump (not illustrated in the drawings), and the like.

As shown in FIG. 1, each head unit HU, which is provided in the head module 10, is provided a recording head HD, in which M discharge sections D are installed (in the present embodiment, M is a nonnegative integer that satisfies $1 \leq M$). Additionally, hereinafter, there are cases in which the respective M discharge sections D are referred to, in order, as a first stage, a second stage, . . . , and an $m^{th}$ stage in order to discriminate therebetween. In addition, hereinafter, there are cases in which a discharge section D of an $m^{th}$ stage is referred to using the term discharge section D[m] (the variable m is a nonnegative integer that satisfies $1 \leq m \leq M$).

Each of the M discharge sections D receives the supply of the ink from the ink cartridges 31 that correspond to the head unit HU in which the M discharge sections D are provided. The inside of each discharge section D is filled with the ink, supplied from the ink cartridges 31, and each discharge section D can discharge the ink, with which it is filled, from the nozzle N, which is installed in the corresponding discharge section D. More specifically, each discharge section D forms dots for configuring an image on the recording sheets P by discharging the ink onto the recording sheets P at a timing with which the transport mechanism 7 transports the recording sheets P onto the platen 74. Further, it is possible to print full color images by discharging ink of the four colors of CMYK overall from the total of (4*M) discharge sections D, which are provided in the four head units HU.

In addition, as shown in FIG. 1, each head unit HU is provided with a supply unit SP, which supplies driving signals Vin driving the discharge sections D that are provided in the recording head HD, to each discharge section D, and a detection unit DT that detects residual vibrations that occur in each discharge section D after the corresponding discharge sections D are driven by the driving signals Vin.

Additionally, hereinafter, in cases in which it is necessary to discriminate between the recording head HD, the supply units SP and the detection units DT for the sake of description, there are cases in which the constituent elements that are provided in the head unit HU1 will be referred to as the recording head HD1, the supply unit SP1 and the detection unit DT1, and in which the constituent elements that are provided in the head units HU2 will be referred to as the recording heads HD2, the supply units SP2 and the detection units DT2.

In addition, hereinafter, in cases in which it is necessary to discriminate therebetween for the sake of description, there are cases in which the discharge sections D that are provided in the recording head HD1 will be referred to as discharge sections D1 (an example of a "first discharge section"), and in which the discharge sections D that are provided in the recording head HD2 will be referred to as discharge sections D2 (an example of a "second discharge section").

In addition, hereinafter, among the 4M discharge sections D that are provided in the ink jet printer 1, there are cases in which a discharge section D that is a target of the detection of residual vibrations by a detection unit DT, will be referred to as a target discharge section Dtg. Although described in more detail later, a target discharge section Dtg is designated from among the 4M discharge sections D by the control section 6.

Each of the four supply units SP that are provided in the ink jet printer 1 is provided with a creation unit GR and a connection unit CN. Additionally, hereinafter, the four supply units SP that are provided in the ink jet printer 1, that is, the single supply unit SP1 and the three supply units SP2, will be collectively referred to as a supply module 5 (an example of a "supply section").

The creation unit GR, which is provided in each supply unit SP, creates the driving signals Vin on the basis of signals such as the printing signal SI, a clock signal CL, and the driving waveform signal Com, which are supplied from the control section 6.

In addition, the connection unit CN, which is provided in each supply unit SP, electrically connects each discharge section D to either one of the creation unit GR and detection unit DT on the basis of a connection control signal Sw (refer to FIG. 18) that is supplied from the control section 6. The driving signals Vin, which are created in the creation unit GR, are supplied to the discharge sections D via the connection unit CN. When the driving signals Vin are supplied, each discharge section D is driven on the basis of the supplied driving signal Vin, and it is possible to discharge the ink, with which the inside of the discharge sections D is filled, onto the recording sheets P.

Additionally, hereinafter, in cases in which it is necessary to discriminate therebetween for the sake of description, the creation unit GR that is provided in the supply unit SP1 will be referred to as a creation unit GR1, the creation units GR that are provided in the supply units SP2 will be referred to as creation units GR2, the connection unit CN that is provided in the supply unit SP1 will be referred to as a connection unit CN1, the connection units CN that are provided in the supply units SP2 will be referred to as connection units CN2, the driving signals Vin that the creation unit GR1 creates will be referred to as driving signals Vin1 (an example of a "first driving signal"), and the driving signals Vin that the creation units GR2 create will be referred to as driving signals Vint (an example of a "second driving signal").

The detection units DT detect residual vibrations that occur in a discharge section D, which is designated as a target discharge section Dtg, after the corresponding discharge section D is driven by a driving signal Vin, as a residual vibration signal Vout. Further, detection unit DT creates a shaped waveform signal Vd by carrying out processes such as removing a noise component, amplifying the signal level, and the like of a detected residual vibration signal Vout, and outputs the created shaped waveform signal Vd. Additionally, in the present embodiment, the supply units SP and the detection units DT are, for example, mounted as electronic circuits on substrates that are provided in the head units HU.

Additionally, hereinafter, in cases in which it is necessary to discriminate therebetween for the sake of description, residual vibration signals Vout, which show the residual vibrations that occur in the discharge sections D1 and that the detection unit DT1 detects, will be referred to as residual vibration signals Vout1, a shaped waveform signal Vd that the detection unit DT1 outputs will be referred to as a shaped waveform signal Vd1 (an example of "a first detection signal"), residual vibration signals Vout, which show the residual vibrations that occur in the discharge sections D2 and that the detection units DT2 detect, will be referred to as residual vibration signals Vout2, and shaped waveform signals Vd that the detection units DT2 output will be referred to as a shaped waveform signals Vd2 (an example of "a second detection signal").

In addition, hereinafter, the four detection units DT that are provided in the ink jet printer 1, that is, the single detection unit DT1 and the three detection units DT2, will be collectively referred to as a detection module 8 (an example of a "detection section").

When the discharge state determination process is executed, each determination unit JU that is provided in the determination module 4 determines the discharge state of ink in a discharge section D that is designated as the target discharge section Dtg, which is a discharge section D that is provided in a head unit HU that corresponds to a corresponding determination unit JU, on the basis of the shaped waveform signal Vd, which the detection unit DT that is provided in the corresponding head unit HU outputs, and creates determination information RS, which shows a corresponding determination result. In the present embodiment, for example, the determination units JU are mounted as electronic circuits on substrates that are provided in locations that differs from those of the head module 10.

Additionally, hereinafter, in cases in which it is necessary to discriminate therebetween for the sake of description, determination information RS that shows a result of determination that the determination unit JU1 executes will be referred to as determination information RS1, and determination information RS that shows a result of determination that the determination units JU2 execute will be referred to as determination information RS2.

In this instance, the discharge state determination process is a series of processes that is executed by the ink jet printer 1 under the control of the control section 6, in which a discharge section D, which is designated as a target discharge section Dtg, is driven by a driving signal Vin that a supply unit SP supplies, the residual vibrations that occur in the corresponding discharge section D are detected by a detection unit DT, and a determination unit JU creates determination information RS on the basis of a shaped waveform signal Vd that the detection unit DT, which detected the residual vibrations, outputs.

Additionally, in the present embodiment, in each head unit HU, the discharge state determination process is executed by respectively setting the M discharge sections D that are provided in the corresponding head unit HU as targets thereof. Additionally, in the four head units HU that the ink jet printer 1 is provided with, a process that includes 4M repetitions of the discharge state determination process for determining the discharge states of ink in the 4M discharge sections D, will be referred to as a determination job.

In addition, hereinafter, there are cases in which description is given by adding a suffix [m], which refers to a stage number m, to the symbols that indicate constituent elements or information that corresponds to a stage number m, and examples of such cases include the determination information RS that shows the discharge state of the ink in a discharge section D[m] of each head unit HU being referred to as determination information RS[m], the driving signal Vin that is supplied to a discharge section D[m] being referred to as a driving signal Vin[m], and the like.

2. Configuration of Recording Head

The recording head HD and the discharge sections D that are provided in the recording head HD will be described with reference to FIGS. 3 and 4.

Figure 3:
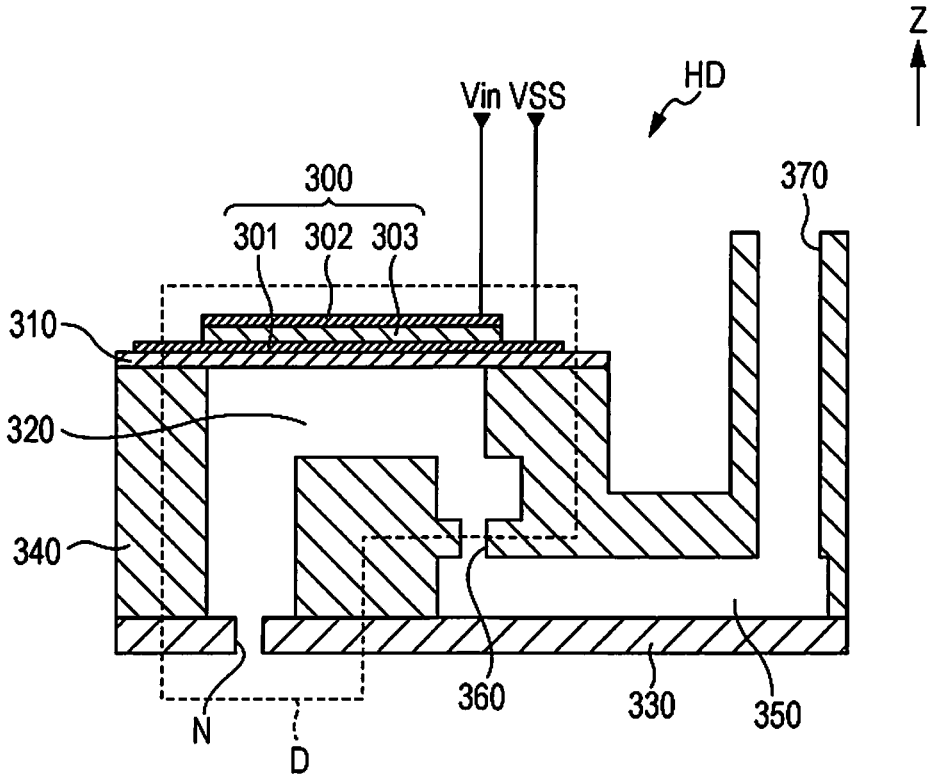
FIG. 3 is a schematic cross-sectional view of a recording head.

FIG. 3 is an example of a schematic partial cross-sectional view of the recording head HD. Additionally, a single discharge section D of the M discharge sections D that the recording head HD includes, a reservoir 350 that is in communication with the corresponding single discharge section D through an ink supply opening 360, and an ink intake opening 370 for supplying the ink to the reservoir 350 from the ink cartridges 31, are shown in the figure, for the convenience of illustration.

As shown in FIG. 3, the discharge section D is provided with a piezoelectric element 300, a cavity 320 (an example of a "pressure chamber"), the inside of which is filled with the ink, a nozzle N that is in communication with the cavity 320, and a vibration plate 310. The discharge section D discharges the ink that is inside the cavity 320 from the nozzle N as a result of the piezoelectric element 300 being driven by the driving signal Vin. The cavity 320 is a space that is partitioned by a cavity plate 340, a nozzle plate 330 in which the nozzle N is formed, and the vibration plate 310. The cavity 320 is in communication with the reservoir 350 through the ink supply opening 360. The reservoir 350 is in communication with a single ink cartridge 31 through the ink intake opening 370.

In the present embodiment, a unimorph (monomorph) type piezoelectric element of the manner shown in FIG. 3, is adopted as the piezoelectric element 300. Additionally, the piezoelectric element 300 is not limited to a unimorph type, and may use a bimorph type, a lamination type or the like.

The piezoelectric element 300 includes a lower section electrode 301, an upper section electrode 302, and a piezoelectric body 303 that is provided between the lower section electrode 301 and the upper section electrode 302. Further, when a voltage is applied between the lower section electrode 301 and the upper section electrode 302 as a result of the lower section electrode 301 being set to a predetermined potential VSS, and the driving signal Vin being supplied to the upper section electrode 302, the piezoelectric element 300 is displaced in the +Z direction and the −Z direction (hereinafter, the +Z direction and the −Z direction will be collectively referred to as a "Z axis direction") depending on the corresponding voltage that is applied, and the piezoelectric element 300 vibrates as a result.

The vibration plate 310 is installed in an upper surface aperture section of the cavity plate 340, and the lower section electrode 301 is joined to the vibration plate 310. Therefore, when the piezoelectric element 300 vibrates due to the driving signal Vin, the vibration plate 310 also vibrates. Further, a volume of the cavity 320 (the pressure inside the cavity 320) changes due to the vibrations of the vibration plate 310, and ink, with which the inside of the cavity 320 is filled, is discharged through the nozzle N. In a case in which the ink inside the cavity 320 is reduced due to discharge of the ink, the ink is supplied from the reservoir 350. In addition, the ink is supplied from the ink cartridges 31 to the reservoir 350 through the ink intake opening 370.

Figure 4:
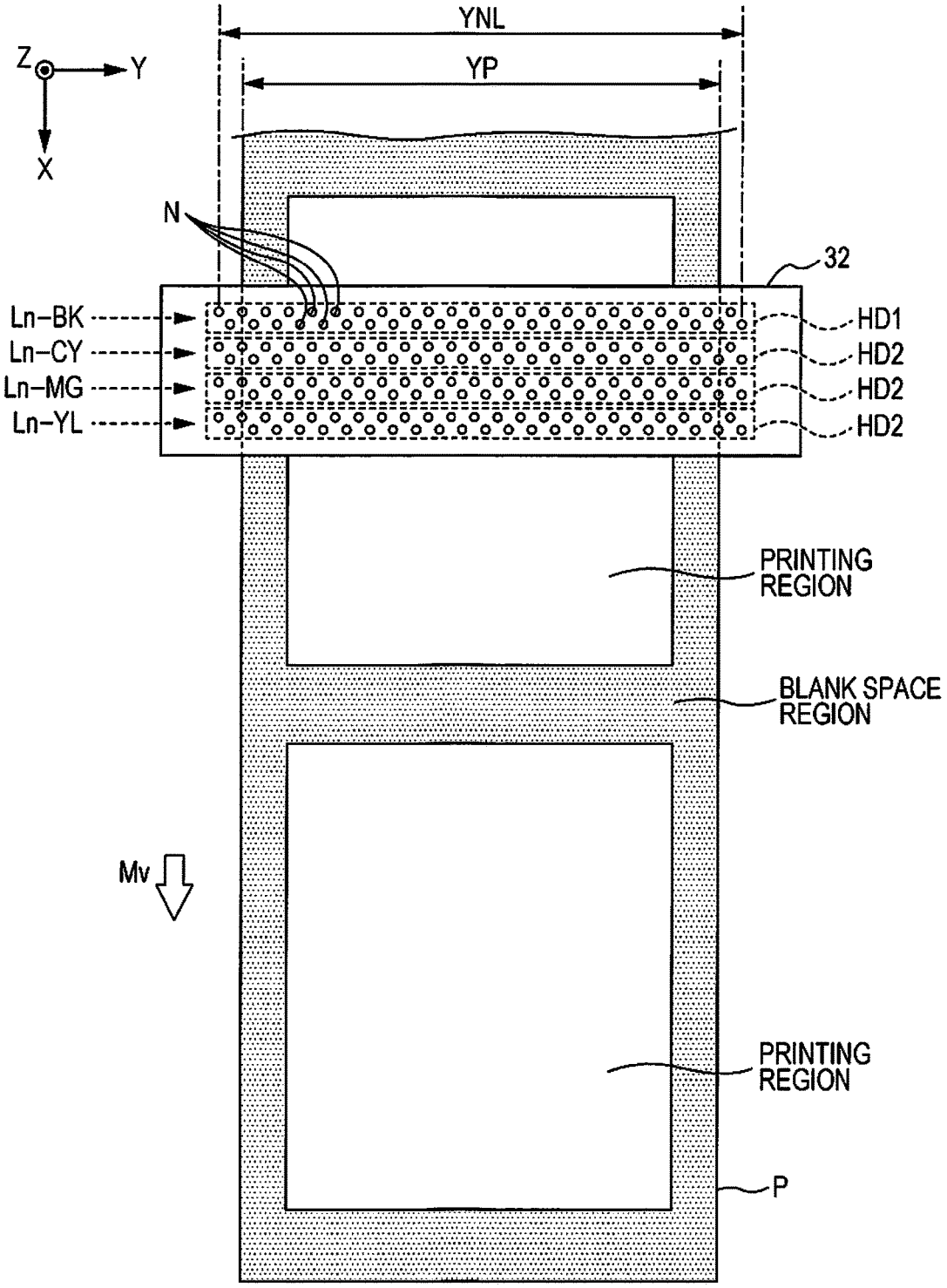
FIG. 4 is a plan view that shows an arrangement example of nozzles in a storage module.

FIG. 4 is an explanatory drawing for describing an example of the disposition of M nozzles N that are respectively provided in the four recording heads HD (the single recording head HD1 and the three recording heads HD2), which are mounted in the storage module 32, in a case in which the ink jet printer 1 is viewed in plan view from the +Z direction or the −Z direction.

As shown in FIG. 4, nozzle rows Ln, which are formed from M nozzles N, are provided in each recording head HD. In other words, the ink jet printer 1 includes four nozzle rows Ln. More specifically, the ink jet printer 1 includes four nozzle rows Ln, which are formed from a nozzle row Ln-BK, a nozzle row Ln-CY, a nozzle row Ln-MG, and a nozzle row Ln-YL. In this instance, the respective M nozzles N that belong to the nozzle row Ln-BK are nozzles N that are provided in a discharge section D1, which discharges black ink, the respective M nozzles N that belong to the nozzle row Ln-CY are nozzles N that are provided in a discharge section D2, which discharges cyan ink, the respective M nozzles N that belong to the nozzle row Ln-MG are nozzles N that are provided in a discharge section D2, which discharges magenta ink, and the respective M nozzles N that belong to the nozzle row Ln-YL are nozzles N that are provided in a discharge section D2, which discharges yellow ink. In addition, in the present embodiment, the respective four nozzle rows Ln are provided so as to extend in a +Y direction or a −Y direction (hereinafter, the +Y direction and the −Y direction will be collectively referred to as a "Y axis direction") when viewed in plan view. Further, in a case of printing on the recording sheets P (to be precise, among the recording sheets P, a recording sheet P in which the width in the Y axis direction is a maximum width on which printing with the ink jet printer 1 is possible), a range YNL over which each nozzle row Ln extends in the Y axis direction is greater than or equal to a range YP in the Y axis direction that the corresponding recording sheets P includes.

As shown in FIG. 4, the M nozzles N that configure each nozzle row Ln are disposed in a so-called zig-zag shape so that the positions in the X axis direction from the −Y side of even-numbered nozzles N and odd-numbered nozzles N differ from one another. However, the disposition of the nozzles N that is shown in FIG. 4 is an example, and each nozzle row Ln may extend in a direction that differs from the Y axis direction, or a plurality of nozzles N that belong to each nozzle row Ln may be disposed in a linear manner.

Additionally, as an example, as shown in FIG. 4, the printing process in the present embodiment divides the recording sheets P into a plurality of printing regions (for example, corresponding A4 sized rectangular regions in a case of printing an A4 sized image on the recording sheets P, or a label on label sheets), and a plurality of blank space regions for respectively partitioning the plurality of printing regions, and assumes a case of forming a plurality of images that correspond to the plurality of printing regions on a one-to-one basis. However, a single printing region may be provided for a single recording sheet P, and a single image may respectively be formed on a plurality of recording sheets P that corresponds to the printing copy number.

3. Actions and Residual Vibrations of Discharge Sections

Next, an ink discharge action from the discharge sections D, and the residual vibrations that occur in the discharge sections D will be described with reference to FIGS. 5 to 13.

Figure 5:
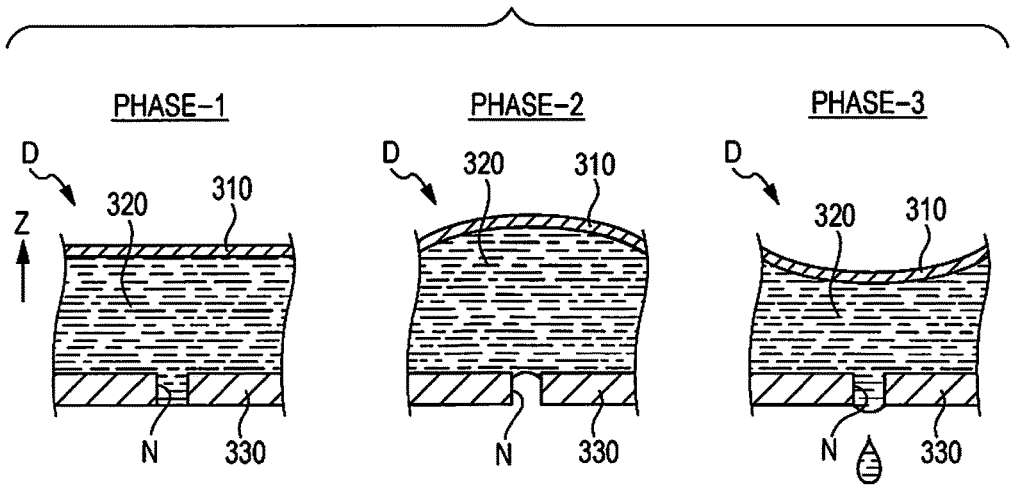
FIG. 5 is an explanatory diagram that shows changes in the cross-sectional shape of a discharge section during supply of a driving signal.

FIG. 5 is an explanatory diagram for describing an ink discharge action from a discharge section D. As shown in FIG. 5, for example, in a state of Phase-1, distortion that displaces a piezoelectric element 300, which a discharge section D is provided with, in the +Z direction, is created as a result of the creation unit GR changing the potential of the driving signal Vin, which is supplied to the corresponding piezoelectric element 300, and the vibration plate 310 of the corresponding discharge section D is warped in the +Z direction as a result. As a result of this, in comparison with the state of Phase-1, in the manner of the state of Phase-2 shown in FIG. 5, the volume of the cavity 320 of the corresponding discharge section D expands. Next, for example, in a state of Phase-2, distortion that displaces the corresponding piezoelectric element 300 in the −Z direction, is created as a result of the creation unit GR changing the potential of the driving signal Vin, and the vibration plate 310 of the corresponding discharge section D is warped in the −Z direction as a result. As a result of this, in the manner of the state of Phase-3 shown in FIG. 5, the volume of the cavity 320 rapidly contracts. At this time, a portion of the ink, with which the cavity 320 is filled, is discharged as ink droplets from the nozzle N, which is in communication with the cavity 320 as a result of a compression pressure, which is created inside the cavity 320.

The discharge section D, which includes the vibration plate 310, vibrates after being displaced in the Z axis direction, as shown in FIG. 5, due to the piezoelectric element 300 and the vibration plate 310 being driven by the driving signal yin. The vibrations that occur in the discharge sections D as a result of driving of the discharge sections D using the driving signals Vin, will be referred to as residual vibrations. It is assumed that the residual vibrations, which are created in the discharge section D include a natural vibration frequency, which is determined by an acoustic resistance Res due to the shapes of the nozzle N and the ink supply opening 360, or the viscosity of the ink, or the like, an inertance Int due to a weight of ink inside flow channels, and a compliance Cm of the vibration plate 310. Hereinafter, a calculation model of the residual vibrations of the discharge section D will be described based on the corresponding assumption.

Figure 6:
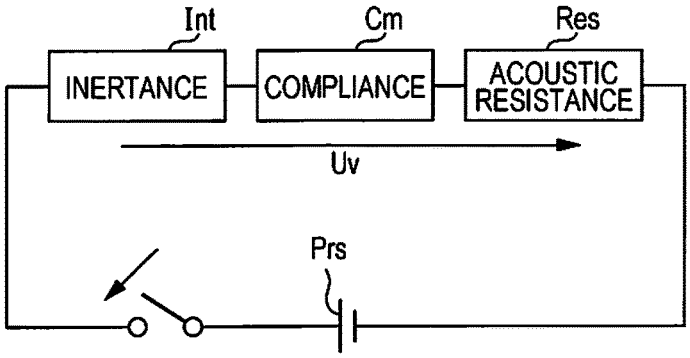
FIG. 6 is a circuit diagram that shows a simple harmonic motion model, which represents residual vibrations in the discharge section.

FIG. 6 is a circuit diagram that shows a simple harmonic motion model, in which residual vibrations of the vibration plate 310 are assumed. As shown in the drawing, the calculation model of the residual vibrations of the vibration plate 310 can be represented by an acoustic pressure Prs, and the abovementioned inertance Int, compliance Cm, and acoustic resistance Res. Further, if a step response when the acoustic pressure Prs is applied to the circuit of FIG. 6, is calculated for a volume velocity Uv, the following equation is obtained.

$$Uv=\{\mathrm{Prs}/(\omega\cdot\mathrm{Int})\}e^{\gamma t}\cdot\sin(\omega t)$$

$$\omega\{1/(\mathrm{Int}-Cm)-\gamma^2\}^{1/2}$$

$$\gamma=\mathrm{Res}/(2\cdot\mathrm{Int})$$

Hereinafter, a calculated value that is obtained from the equation, and an experimental result (an experiment value) in an experiment of the residual vibrations of the discharge section D which is performed separately, are compared.

Figure 7:
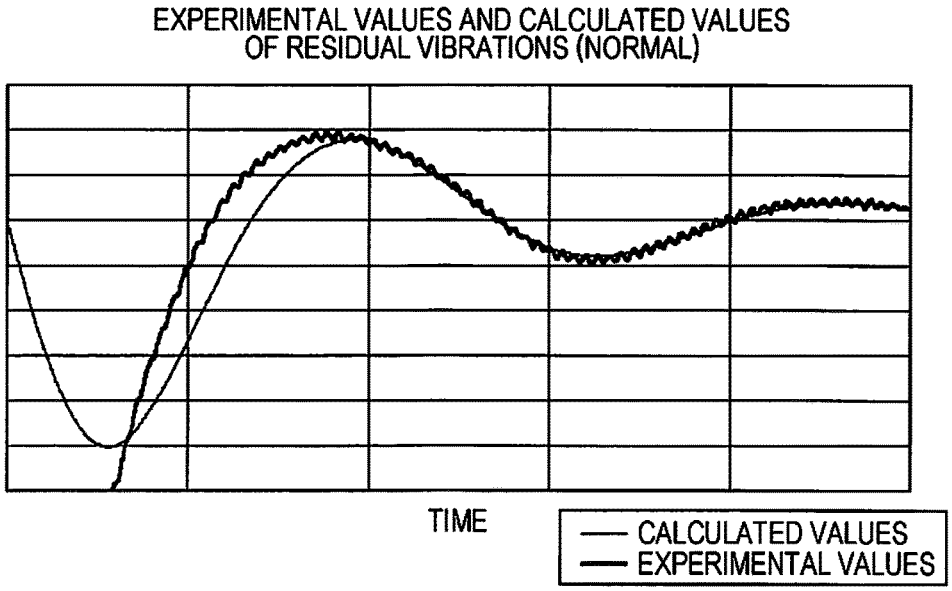
FIG. 7 is a graph that shows a relationship between experimental values and calculated values of residual vibrations in the discharge section.

FIG. 7 is a graph that shows a relationship between experimental values and calculated values of the residual vibrations. Additionally, the experimental values that are shown in FIG. 7 are values that are obtained using an experiment that detects the residual vibrations that occur in the vibration plate 310 of a discharge section D, in which the discharge state of the ink is normal, after ink is discharged from the corresponding discharge section D. As shown in FIG. 7, in a case in which the discharge state of the ink in the discharge section D is normal, two waveforms of the experimental values and the calculated values generally coincide.

Meanwhile, irrespective of whether or not the discharge section D performed an ink discharge action, there are cases in which the discharge state of the ink in the corresponding discharge section D is abnormal, and ink droplets are not normally discharged from the nozzle N of the corresponding discharge section D, that is, there are cases in which there is a discharge abnormality. Examples of possible causes of a discharge abnormality include (1) the incorporation of an air bubble inside the cavity 320, (2) thickening or fixing of the ink inside the cavity 320 caused by drying of the ink inside the cavity 320, (3) the attachment of foreign matter such as paper dust to the vicinity of an outlet of the nozzle N, and the like.

Hereinafter, on the basis of the comparison results that are shown in FIG. 7, at least either one of the acoustic resistance Res and the inertance Int will be adjusted for each cause of a discharge abnormality that occurs in the discharge section D so that the calculated values and the experiment values of the residual vibrations generally coincide.

Figure 8:
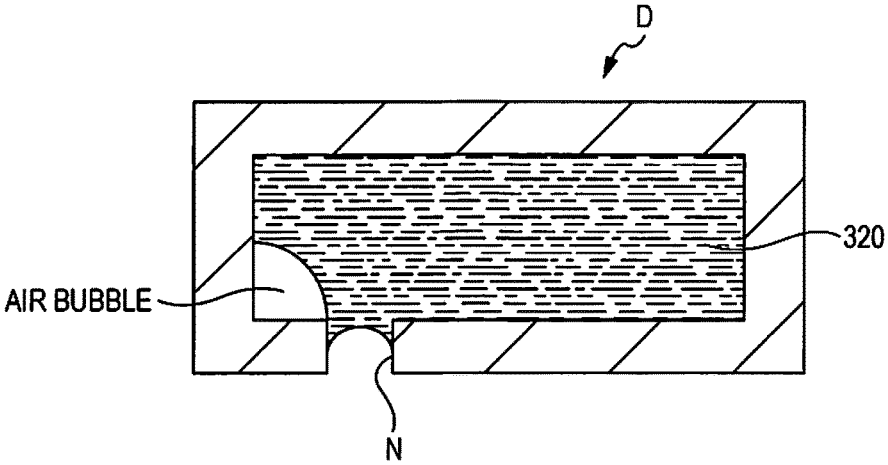
FIG. 8 is an explanatory diagram that shows a state of the discharge section in a case in which an air bubble is incorporated inside the discharge section.
Figure 9:
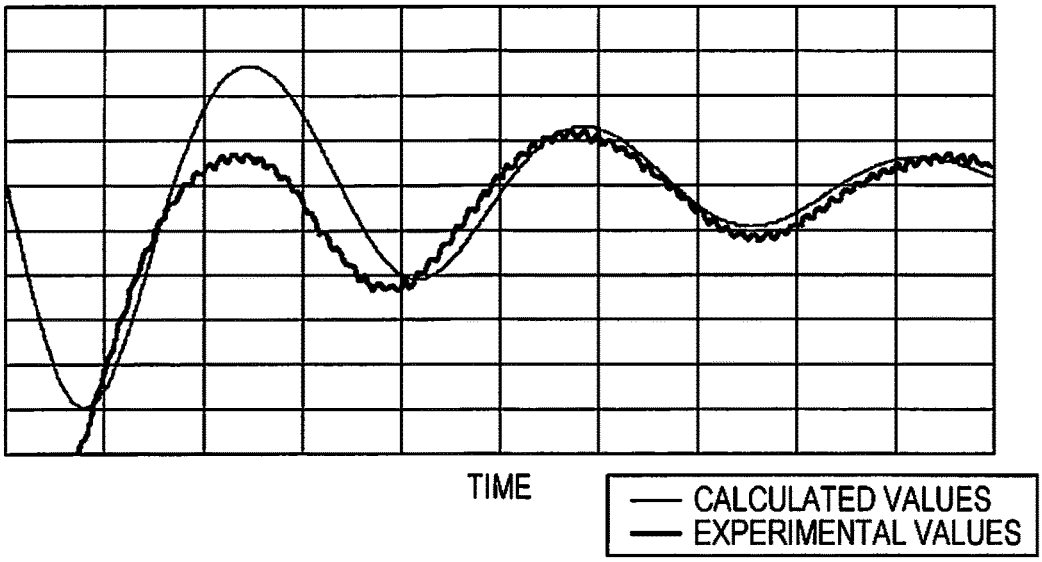
FIG. 9 is a graph that shows experimental values and calculated values of residual vibrations in the discharge section.

FIG. 8 is a conceptual drawing for, among the discharge abnormalities, describing (1) the incorporation of an air bubble inside the cavity 320. As shown in FIG. 8, in a case in which an air bubble is incorporated inside the cavity 320, a total weight of ink inside the cavity 320 is reduced, and therefore, the inertance Int decreases. In addition, in a case in which an air bubble is attached to the vicinity of the of the nozzle N, a state in which it is supposed that the diameter of the N is increased by an amount that is equivalent to the diameter of the air bubble, is attained, and therefore, the acoustic resistance Res decreases. In such an instance, a graph such as that of FIG. 9 is obtained by setting the acoustic resistance Res and the inertance Int to be smaller than the case shown in FIG. 7, and matching with experiment values of the residual vibrations when an air bubble is incorporated. As shown in FIGS. 7 and 9, in a case in which an air bubble is incorporated inside the cavity 320 and a discharge abnormality occurs, the frequency of the residual vibrations is higher than a case in which the discharge state is normal.

Figure 10:
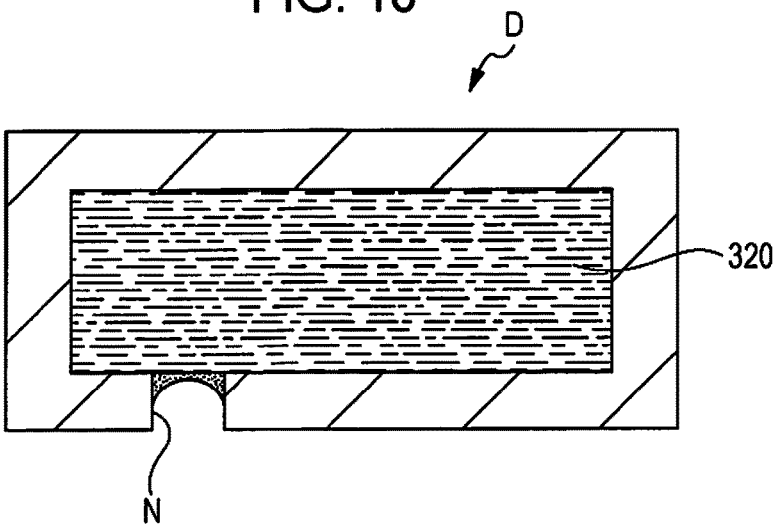
FIG. 10 is an explanatory diagram that shows a state of the discharge section in a case in which ink in the vicinity of a nozzle is fixed.
Figure 11:
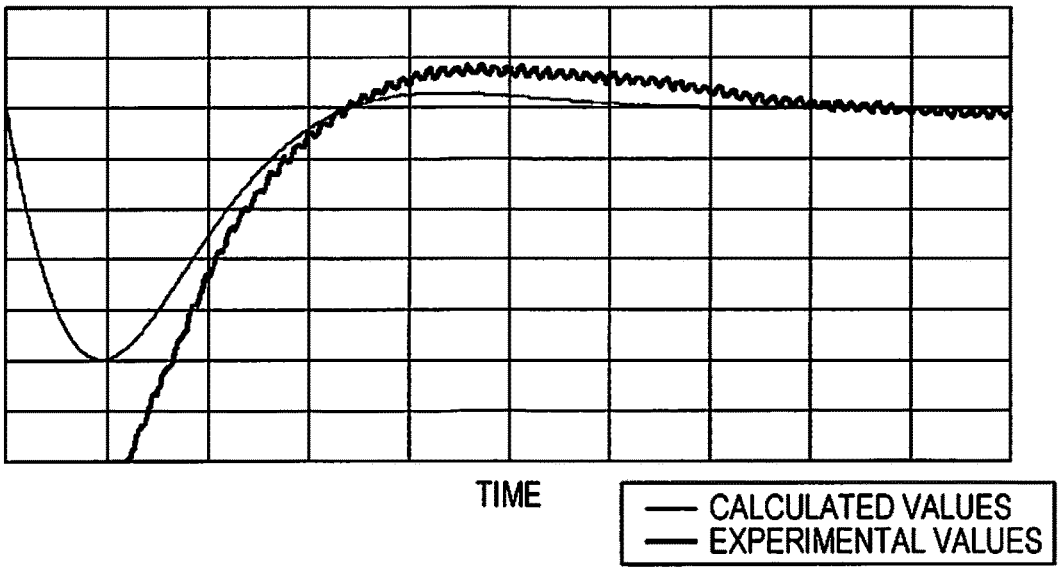
FIG. 11 is a graph that shows experimental values and calculated values of residual vibrations in the discharge section.

FIG. 10 is a conceptual drawing for, among the discharge abnormalities, describing (2) thickening or fixing of the ink inside the cavity 320. As shown in FIG. 10, in a case in which the ink in the vicinity of the nozzle N becomes fixed due to drying, a circumstance in which the ink inside the cavity 320 is confined inside the cavity 320, is attained. In such a case, the acoustic resistance Res increases. In such an instance, a graph such as that of FIG. 11 is obtained by setting the acoustic resistance Res to be larger than the case shown in FIG. 7, and matching with experiment values of the residual vibrations in a case in which the ink in the vicinity of the nozzle N becomes fixed or thickens. Additionally, the experiment values that are shown in FIG. 11 are values for which the residual vibrations of the vibration plate 310, which a discharge section D is provided with, are measured in a state in which the corresponding discharge section D is left in a state in which a cap (not illustrated in the drawings) is not installed, and the ink in the vicinity of the nozzle N becomes fixed. As shown in FIGS. 7 and 11, in a case in which the ink in the vicinity of the nozzle N becomes fixed inside the cavity 320, in comparison with a case in which the discharge state is normal, the frequency of the residual vibrations is reduced, and a characteristic waveform, in which the residual vibrations are overdampened, is obtained.

Figure 12:
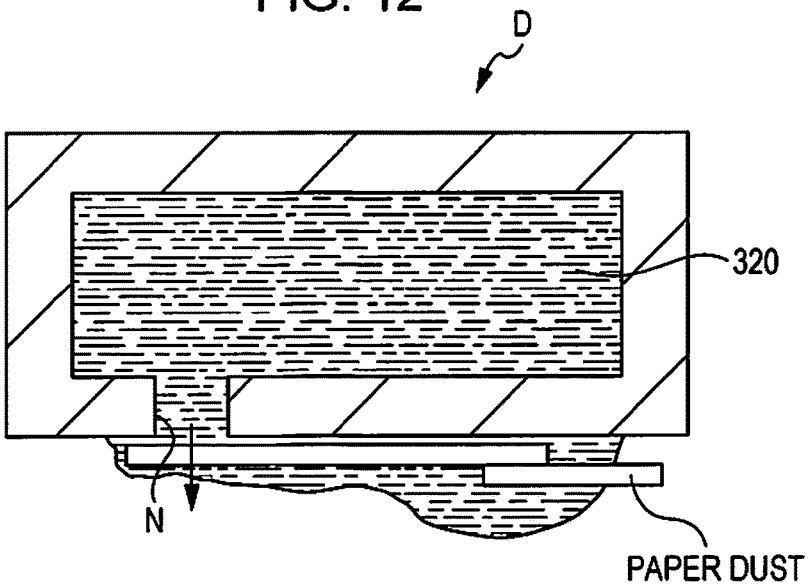
FIG. 12 is an explanatory drawing that shows a state of the discharge section in a case in which paper dust is attached thereto.
Figure 13:
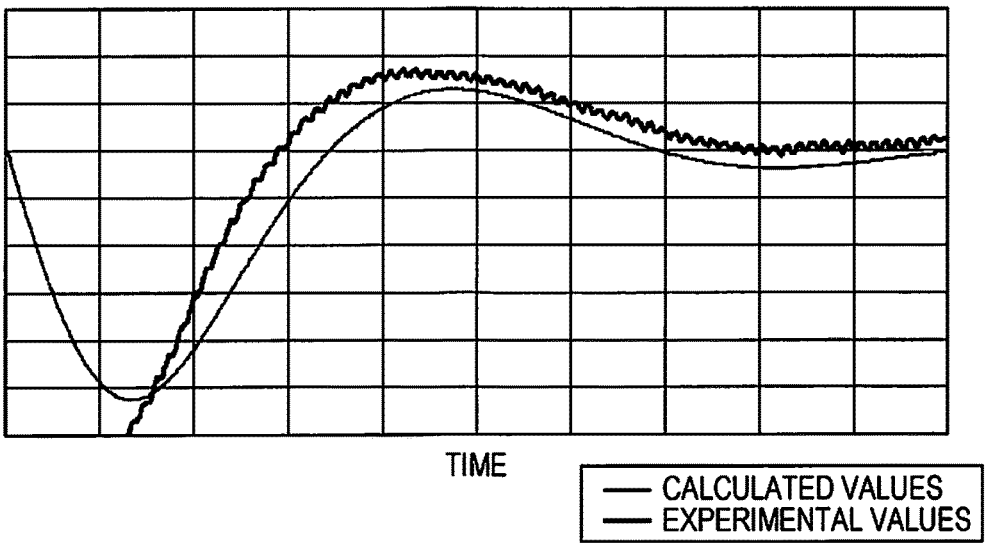
FIG. 13 is a graph that shows experimental values and calculated values of residual vibrations in the discharge section.

FIG. 12 is a conceptual drawing for, among the discharge abnormalities, describing (3) the attachment of foreign matter such as paper dust to the vicinity of the outlet of the nozzle N. As shown in FIG. 12, in a case in which foreign matter becomes adhered to the vicinity of the outlet of the nozzle N, the ink seeps out from inside the cavity 320 through the foreign matter, and it is no longer possible to discharge the ink from the nozzle N. In a case in which ink is seeping out from the nozzle N, it is supposed that in comparison with a case in which ink is not seeping out, a weight of the ink with which the inside of the cavity 320 is filled, is increased by an amount that is equivalent to a weight that corresponds to ink that has seeped out. In other words, in a case in which ink is seeping out from the nozzle N, the inertance Int increases. In addition, the acoustic resistance Res also increases as a result of the foreign matter that is attached to the vicinity of the outlet of the nozzle N. In such an instance, a graph such as that of FIG. 13 is obtained by setting the inertance Int and the acoustic resistance Res to be larger than the case that is shown in FIG. 7, and matching with experiment values of the residual vibrations when foreign matter is attached to the vicinity of the outlet of the nozzle N. As can be understood from FIGS. 7 and 13, in a case in which foreign matter is attached to the vicinity of the outlet of the nozzle N, the frequency of the residual vibrations is lower than a case in which the discharge state is normal.

Additionally, from FIGS. 11 and 13, it can be understood that the frequency of the residual vibrations is higher in the case of (3) the attachment of foreign matter to the vicinity of the outlet of the nozzle N than in the case of (2) the thickening of the ink inside the cavity 320.

As is evident from the abovementioned explanation, it is possible to determine the discharge state of the ink in the discharge section D on the basis of the waveform of the residual vibrations, which are created when the discharge section D is driven, and in particular, the frequency or the period length of the residual vibrations. More specifically, by comparing the frequency or period length of the residual vibrations with threshold values established in advance, it is possible to determine whether or not the discharge state in the discharge section D is normal, and, in a case in which the discharge state in the discharge section D is abnormal, to determine which of the abovementioned (1) to (3) the cause of a corresponding discharge abnormality corresponds to. The ink jet printer 1 according to the present embodiment executes the discharge state determination process, which determines the discharge state in a discharge section D by analyzing residual vibrations that occur in the corresponding discharge section D.

4. Configurations and Actions of Head Unit and Determination Unit

Next, the creation units GR, the connection units CN, the detection units DT, which are provided in each head unit HU, and the determination units JU will be described with reference to FIGS. 14 to 21.

4.1 Creation Unit

Figure 14:
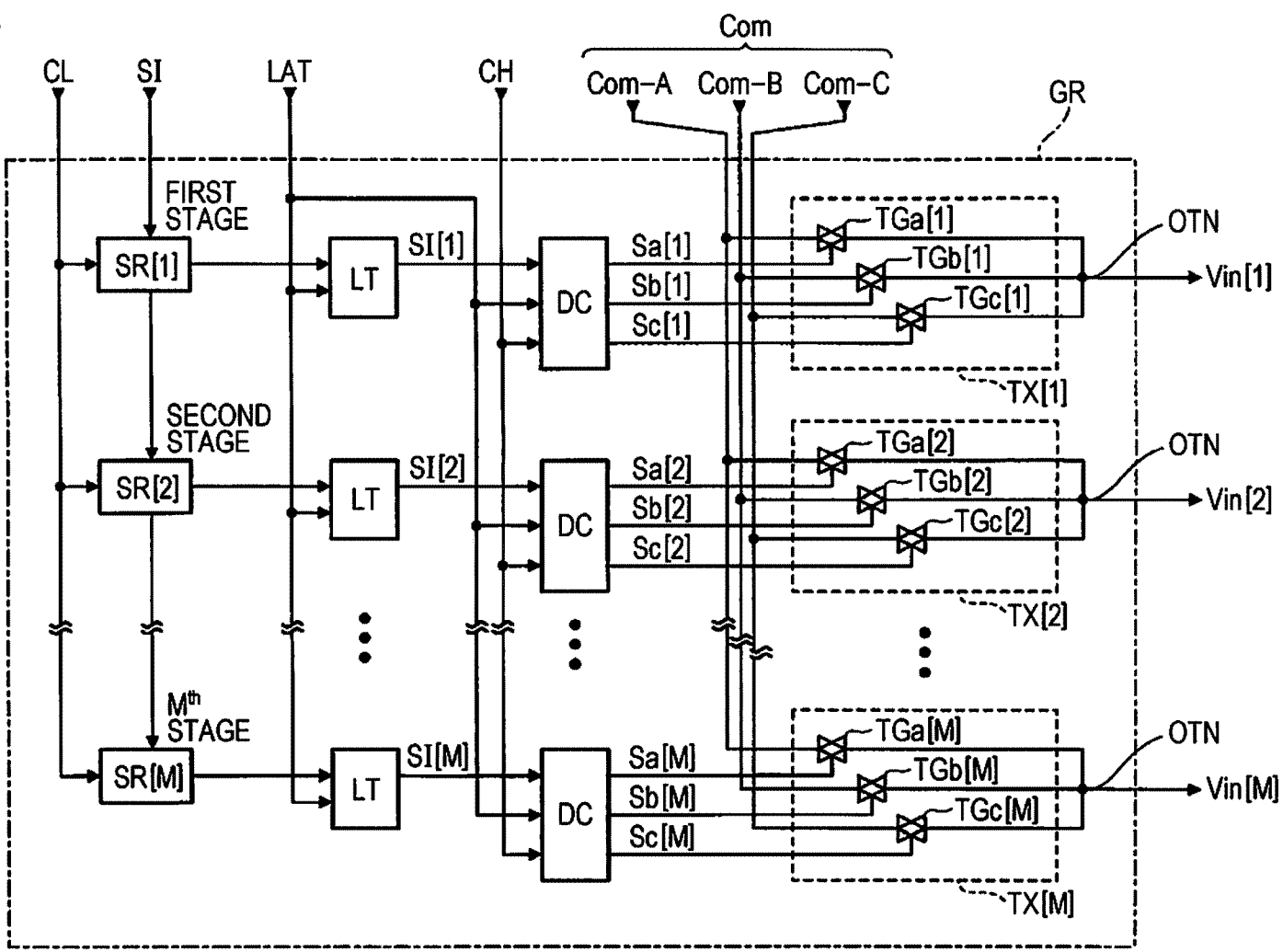
FIG. 14 is a block diagram that shows a configuration of a creation unit.

FIG. 14 is a block diagram that shows a configuration of each creation unit GR.

As shown in FIG. 14, the creation unit GR that is provided in each head unit HU includes M stages in which sets, which are formed from a shift register SR, a latch circuit LT, a decoder DC, and a switching section TX, correspond to the M discharge sections D that are provided in the corresponding head unit HU on a one-to-one basis.

The clock signal CL, the printing signal SI, a latch signal LAT, a change signal CH, and the driving waveform signal Com are supplied to each creation unit GR from the control section 6.

The driving waveform signal Com is a signal that includes a plurality of waveforms for driving the discharge sections D, and in the abovementioned manner, includes the driving waveform signals Com-A, Com-B and Com-C.

The printing signal SI is a signal for designating a waveform of the driving waveform signal Com that should be supplied to the M discharge sections D that a head unit HU, which the corresponding printing signal SI is supplied to, includes. The printing signal SI includes printing signals SI[1] to SI[M]. Among these, a printing signal SI[m] designates a waveform of the driving waveform signal Com that should be supplied to a discharge section D[m]. As a result of this, a printing signal SI[m] designates a discharge section D[m] as a target discharge section Dtg, which is a target of the discharge state determination process, and, in addition, designates the presence or absence of the discharge of ink from a discharge section DM and an amount of ink that should be discharged. Further, a creation unit GR supplies a driving signal Vin[m], which includes a waveform that a printing signal SI[m] designates from among the plurality of waveforms that the driving waveform signal Com includes, to a discharge section DM.

In the present embodiment, a case in which a printing signal SI[m] is a 3-bit digital signal that is formed from bits b1, b2 and b3 is assumed. Further, although described in detail using FIG. 15, a case in which the three bits (b1, b2 and b3) that a printing signal SIM shows, can adopt five values of a value (0, 0, 1), which designates the supply of an detection waveform PT for performing the discharge state determination process, a value (1, 1, 0), which designates the supply of a waveform for discharging an amount of ink that corresponds to a large dot from a discharge section D[m], a value (1, 0, 0), which designates the supply of a waveform for discharging an amount of ink that corresponds to a medium dot from a discharge section D[m], a value (0, 1, 0), which designates the supply of a waveform for discharging an amount of ink that corresponds to a small dot from a discharge section DM, and a value (0, 0, 0), which designates the supply of a waveform for causing microvibrations to occur in a discharge section DM while maintaining non-discharge of ink from a discharge section D[m], is assumed.

Additionally, although the details will be mentioned later in FIG. 16, the detection waveform PT is a waveform for causing residual vibrations to occur in a discharge section D in a case in which the corresponding discharge section D is driven by a signal that includes the detection waveform PT, and detecting the residual vibrations.

The control section 6 creates the printing signal SI on the basis of the printing data Img in a case in which the ink jet printer 1 is executing a printing process. More specifically, the control section 6 determines an amount of ink that a discharge section D[m] should discharge in order to form an image that the printing data Img shows, and creates a printing signal SIM that designates the corresponding amount of ink.

On the other hand, the control section 6 creates the printing signal SI on the basis of the printing data Img in a case in which the ink jet printer 1 is executing a discharge state determination process. More specifically, firstly, the control section 6 selects a target discharge section Dtg from among the M discharge sections D each head unit HU is provided with. Further, the control section 6 creates a printing signal SIM, which designates the supply of the detection waveform PT to a discharge section DM that is selected as a target discharge section Dtg. In addition, the control section 6 creates a printing signals SI[m], which designate that microvibrations are caused as non-discharge of ink for discharge sections D[m] that are not selected as a target discharge section Dtg.

Additionally, in the present embodiment, a case in which the discharge state determination process and the printing process are executed at different timings (in other words, detection separate from character printing), is assumed. In other words, in the present embodiment, a case in which the discharge state determination process is only executed during periods in which the printing process is not being executed, is assumed.

However, the invention of the present application is not limited to such an aspect, and may execute the discharge state determination process in periods in which the printing process is being executed (in other words, detection during character printing). Additionally, in a case in which the control section 6 executes the discharge state determination process in a period in which the printing process is being executed, for example, the discharge state determination process may be executed by selecting a discharge section D as a target discharge section Dtg at a timing at which it is not necessary for the corresponding discharge section D to discharge ink in order to form an image that the printing data Img shows.

Given that, action periods, which are periods in which the ink jet printer 1 executes various processes such as the printing process and the discharge state determination process, are configured from a plurality of unit periods Tu. Further, the control section 6 repeatedly supplies the abovementioned creation of the printing signal SI (the printing signals SI[1] to SIM) to each creation unit GR every unit period Tu.

In addition, in a case in which the ink jet printer 1 executes the discharge state determination process, for example, the control section 6 designates a single discharge section D from each detection unit DT as a target discharge section Dtg in a single unit period Tu, and designates M discharge sections D[1] to D[M] that each detection unit DT is provided with as target discharge sections Dtg, in M unit periods Tu.

In addition, in a case in which the ink jet printer 1 executes a printing process, the control section 6 drives in a manner that executes either one of the discharge of an amount of ink that corresponds to a large dot, the discharge of an amount of ink that corresponds to a medium dot, the discharge of an amount of ink that corresponds to a small dot, or non-discharge of ink in each discharge sections D in each unit period Tu.

The shift registers SR temporarily maintain the printing signals SI [1] to SI[M], which are supplied in serial, for each three bits that correspond to each discharge section D. More specifically, the shift registers SR have a configuration in which M shift registers SR of the first stage, the second stage, . . . , and an $m^{th}$ stage, which correspond to the M discharge sections D on a one-to-one basis, are cascade connected with one another, and sequentially transmit the supplied printing signal SI to later stages in accordance with the clock signal CL. Further, when the printing signal SI is transmitted by all of the M shift registers SR, a state in which each of the M shift registers SR maintains three bits of data among the printing signal SI that correspond to itself, is retained. Hereinafter, a shift register SR of an $m^{th}$ stage will be referred to as a shift register SR[m].

M latch circuits LT respectively latch the three bit printing signals SI[m], which are respectively maintained by the M shift registers SR, and correspond to each stage, in a concurrent manner at a timing at which the latch signal LAT rises. That is, the latch circuit LT of an $m^{th}$ stage latches the printing signal SI[m], which is maintained by the shift register SR[m].

The control section 6 supplies the printing signal SI and the driving waveform signal Com to each creation unit GR every unit period Tu, and supplies the latch signal LAT in a manner in which the latch circuits LT latch a printing signal SI[m] every unit period Tu. As a result of this, in each unit period Tu, the control section 6 controls the creation units GR in a manner that creates a driving signal Vin[m] that should be supported to a discharge section D[m].

Additionally, in the present embodiment, the control section 6 divides the unit periods Tu into a control period TSx and a control period TSy using the change signal CH. In the present embodiment, the control periods TSx and TSy include mutually equivalent durations. Hereinafter, there are cases in which the control periods TSx and TSy are collectively referred to as a control period TS.

A decoder DC decodes a printing signals SIM that is latched by a latch circuits LT, and outputs selection signals Sa[m], Sb[m] and Sc[m].

FIG. 15 is an explanatory drawing that shows an example of decoding contents of a decoder DC of an $m^{th}$ stage in each unit period Tu.

As shown in the drawing, a decoder DC of an $m^{th}$ stage outputs selection signals Sa[m], Sb[m] and Sc[m] of levels that depend on values that the bits b1, b2 and b3, which a printing signal SIM includes, show, in the respective control periods TSx and TSy of each unit period Tu. In the present embodiment, among selection signals Sa[m], Sb[m] and Sc[m], a decoder DC of an $m^{th}$ stage sets one signal to an H level, and sets another two signals to an L level in the respective control periods TSx and TSy of each unit period Tu. More specifically, as shown in FIG. 15, among the printing signal SI[m], a decoder DC of an $m^{th}$ stage sets a selection signal Sc[m] to an H level in the control periods TSx and TSy if the bit b3 is "1", sets a selection signal Sa[m] to an H level in the control period TSx if the bit b3 is "0" and the bit b1 is "1", sets a selection signal Sa[m] to an H level in the control period TSy if the bit b3 is "0" and the bit b2 is "1", sets a selection signal Sb[m] to an H level in the control period TSx if the bit b3 is "0" and the bit b1 is "0", and sets a selection signal Sb[m] to an H level in the control period TSy if the bit b3 is "0" and the bit b2 is "0".

As shown in FIG. 14, the creation units GR are provided with M switching sections TX in a manner that corresponds to the M discharge sections D on a one-to-one basis. A switching section TX[m] of an $m^{th}$ stage is provided with a transmission gate TGa[m], which is turned on in a control period TS in which a selection signal Sa[m] reaches an H level, and is turned off otherwise, a transmission gate TGb[m], which is turned on in a control period TS in which a selection signal Sb[m] reaches an H level, and is turned off otherwise, and a transmission gate TGc[m], which is turned on in a control period TS in which a selection signal Sc[m] reaches an H level, and is turned off otherwise.

As shown in FIG. 14, the driving waveform signal Com-A is supplied to an end of a transmission gate TGa[m], the driving waveform signal Com-B is supplied to an end of a transmission gate TGb[m] and the driving waveform signal Com-C is supplied to an end of a transmission gate TGc[m]. In addition, the other ends of the transmission gates TGa[m], TGb[m] and TGc[m] are electrically connected to an output end OTN of an $m^{th}$ stage. That is, a switching section TX[m] selects a single signal from among the driving waveform signals Com-A, Com-B and Com-C in each control period TS, and supplies the selected signal to a discharge section D[m] as a driving signal Vin[m] via an output end OTN of an $m^{th}$ stage. More specifically, in each control period TS, a switching section TX[m] supplies the driving waveform signal Com-A, as a driving signal Vin[m], to a discharge section D[m] if a selection signal Sa[m] is an H level, supplies the driving waveform signal Com-B, as a driving signal Vin[m], to a discharge section D[m] if a selection signal Sb[m] is an H level, and supplies the driving waveform signal Com-C, as a driving signal Vin[m], to a discharge section D[m] if a selection signal Sc[m] is an H level.

Figure 16:
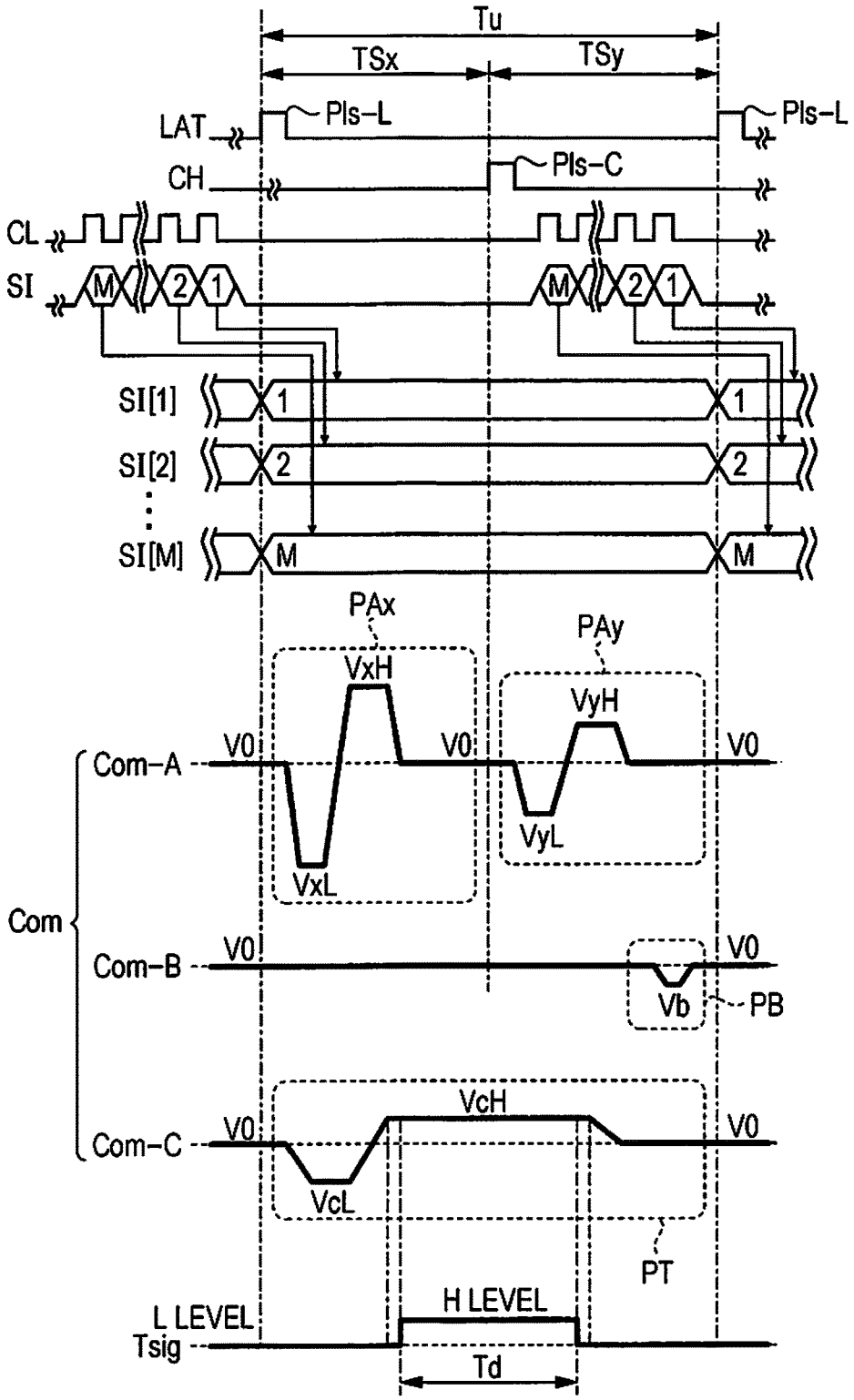
FIG. 16 is a timing chart that shows a waveform of a driving waveform signal.

FIG. 16 is a timing chart for describing signals, such as the driving waveform signal Com, that the control section 6 supplies to each creation unit GR in each unit period Tu.

As shown in FIG. 16, unit periods Tu are divided by a pulse Pls-L, which is included in the latch signal LAT, and in addition, the control periods TSx and TSy are divided by a pulse Pls-C, which is included in the change signal CH.

The control section 6 supplies the printing signals SI[1] to SI[M] to each creation unit GR in synchronization with the clock signal CL prior to the initiation of each unit period Tu. Further, the shift registers SR of the creation unit GR sequentially transmit the supplied printing signals SI[m] to later stages in accordance with the clock signal CL.

As is illustrated in FIG. 16 by way of example, the driving waveform signal Com-A, which the control section 6 outputs in each the unit printing period Tu, includes a discharge waveform PAx, which is provided in the control period TSx, and a discharge waveform PAy, which is provided in the control period TSy.

The discharge waveform PAx is a waveform according to which a medium amount of the ink, which corresponds to a medium dot, is discharged from a discharge section D[m] when a driving signal Vin[m] that includes the discharge waveform PAx, is supplied to a discharge section D[m].

The discharge waveform PAy is a waveform according to which a small amount of the ink, which corresponds to a small dot, is discharged from a discharge section D[m] when a driving signal Vin[m] that includes the discharge waveform PAy, is supplied to a discharge section D[m].

For example, a difference in potential between the lowest potential (a potential VxL in this example) and the highest potential (a potential VxH in this example) of the discharge waveform PAx is greater than a difference in potential between the lowest potential (a potential VyL in this example) and the highest potential (a potential VyH in this example) of the discharge waveform PAy.

Additionally, the driving waveform signal Com-A is established so as to be equivalent to a reference potential V0 at the start and at the end of the control periods TSx and TSy.

As is illustrated in FIG. 16 by way of example, the driving waveform signal Com-B, which the control section 6 outputs in each unit period Tu, includes a micro vibration waveform PB, which is provided in the control period TSy.

The micro vibration waveform PB is a waveform according to which the ink is not discharged from a discharge section D[m] in a case in which a driving signal Vin[m] that includes the micro vibration waveform PB is supplied to a discharge section D[m]. In other words, the micro vibration waveform PB is a waveform for preventing thickening of the ink by applying micro vibrations to the ink inside the discharge sections D. For example, a difference in potential between the lowest potential (a potential Vb in this example) and the highest potential (the reference potential V0 in this example) of the micro vibration waveform PB is established so as to be smaller than a difference in potential between the lowest potential and the highest potential of the discharge waveform PAy.

Additionally, the driving waveform signal Com-B is established so as to be equivalent to the reference potential V0 at the start and at the end of the control periods TSx and TSy.

As is illustrated in FIG. 16 by way of example, the driving waveform signal Com-C, which the control section 6 outputs in each unit period Tu, includes the detection waveform PT, which is provided in the control periods TSx and TSy.

The detection waveform PT is a waveform according to which the ink is not discharged from a discharge section D[m] in a case in which a driving signal Vin[m] that includes the detection waveform PT is supplied to a discharge section D[m]. In other words, it is assumed that the discharge state determination process according to the present embodiment is a case of so-called "non-discharge detection", which determines the discharge state of the ink in the discharge sections D on the basis of the residual vibrations that occur in the discharge sections D when the corresponding discharge sections D are driven in a manner that does not discharge the ink.

In the present embodiment, as shown in FIG. 16, a case in which a waveform that changes from the reference potential V0→a potential VcL→a potential VcH→the reference potential V0 in a unit period Tu, is assumed as the detection waveform PT. Additionally, in this example, a case in which the potential VcL is a lower potential than the reference potential V0, and the potential VcH is a higher potential than the reference potential V0, is assumed.

Additionally, as is illustrated by way of example in FIG. 16, the control section 6 outputs a detection period designation signal Tsig, which, among the unit period Tu, reaches an H level in a detection period Td, to the supply units SP. In this instance, the detection period Td is a period of a portion in a period in which the potential of the driving waveform signal Com-C, which includes the detection waveform PT, is set to the potential VcH. In the present embodiment, a case in which the micro vibration waveform PB is provided after the end of the detection period Td in the unit period Tu.

Figure 17:
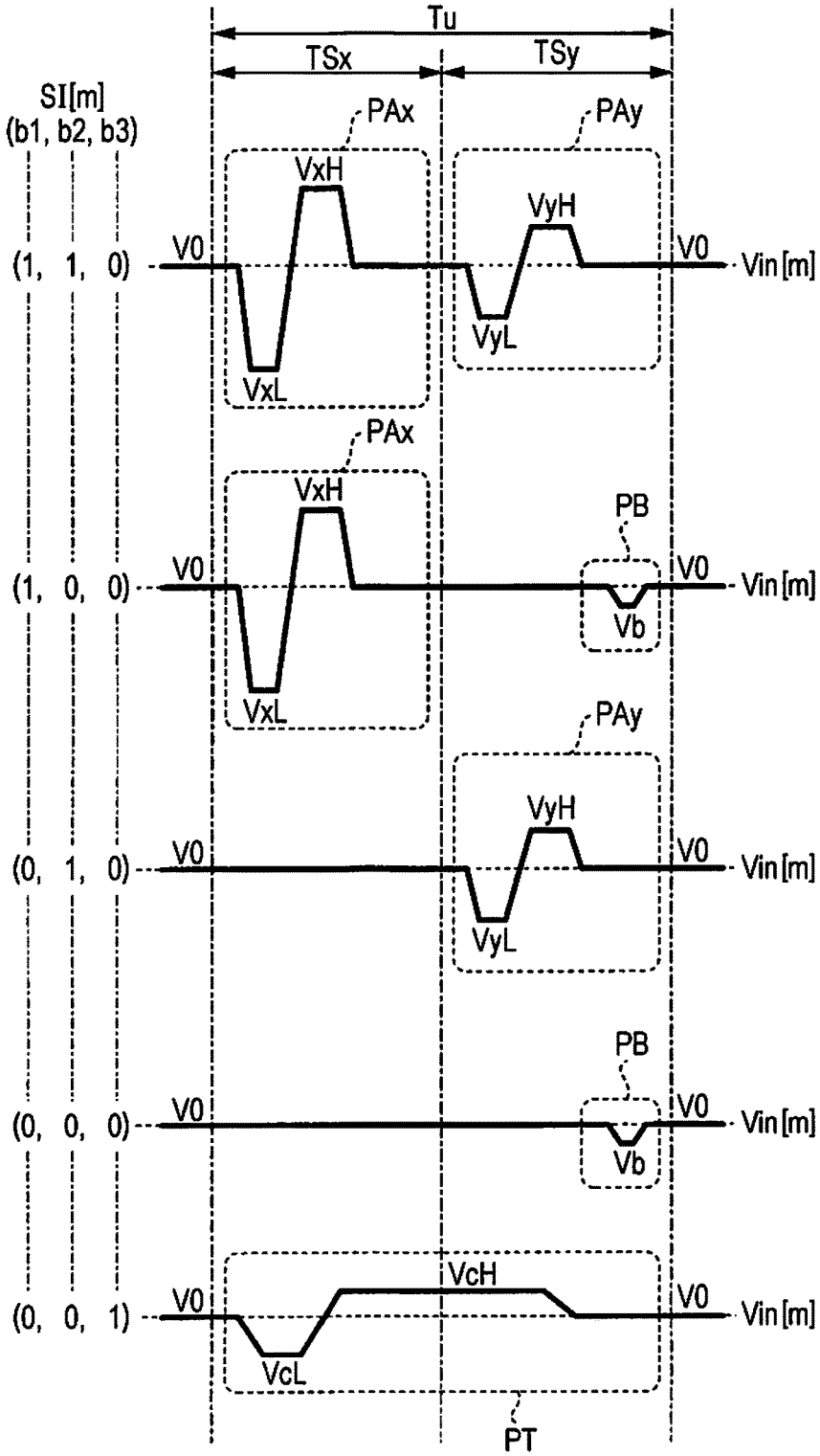
FIG. 17 is a timing chart that shows a waveform of the driving signal.

Next, the driving signals Vin that the creation units GR output in a unit period Tu will be described with reference to FIG. 17 in addition to FIGS. 14 to 16.

In a case in which a printing signal SI[m] that is supplied in a unit period Tu shows (1, 1, 0), as shown in FIG. 15, a selection signal Sa[m] reaches an H level in the control periods TSx and TSy. In this case, a switching section TX[m] outputs a driving signal Vin[m], which includes the discharge waveform PAx by selecting the driving waveform signal Com-A in the control period TSx, and outputs a driving signal Vin[m], which includes the discharge waveform PAy by selecting the driving waveform signal Com-A in the control period TSy. Accordingly, in this case, as shown in FIG. 17, a driving signal Vin[m], which is supplied to a discharge section D[m] in a unit period Tu, includes the discharge waveform PAx and the discharge waveform PAy. As a result of this, a discharge section D[m] discharges a medium amount of ink based on the discharge waveform PAx, and a small amount of ink based on the discharge waveform PAy in the corresponding unit period Tu, and forms a large dot on the recording sheets P as a result of the ink that is discharged during the above-mentioned two repetitions.

In a case in which a printing signal SI[m] that is supplied in a unit period Tu shows (1, 0, 0), as shown in FIG. 15, a selection signal Sa[m] reaches an H level in the control period TSx and a selection signal Sb[m] reaches an H level in the control period TSy. In this case, a switching section TX[m] outputs a driving signal Vin[m] that includes the discharge waveform PAx by selecting the driving waveform signal Com-A in the control period TSx, and outputs a driving signal Vin[m] that includes the micro vibration waveform PB by selecting the driving waveform signal Com-B in the control period TSy. Accordingly, in this case, as shown in FIG. 17, a driving signal Vin[m], which is supplied to a discharge section D[m] in a unit period Tu includes the discharge waveform PAx and the micro vibration waveform PB. As a result of this, a discharge section D[m] discharges a medium amount of the ink on the basis of the discharge waveform PAx in the corresponding unit period Tu, and forms a medium dot on the recording sheets P.

In a case in which a printing signal SI[m] that is supplied in a unit period Tu shows (0, 1, 0), as shown in FIG. 15, a selection signal Sb[m] reaches an H level in the control period TSx and a selection signal Sa[m] reaches an H level in the control period TSy. In this case, a switching section TX[m] outputs a driving signal Vin[m] that is set to the potential V0 by selecting the driving waveform signal Com-B in the control period TSx, and outputs a driving signal Vin[m] that includes the discharge waveform PAy by selecting the driving waveform signal Com-A in the control period TSy. Accordingly, in this case, as shown in FIG. 17, the driving signal Vin[m], which is supplied to a discharge section D[m] in the unit period Tu, includes the discharge waveform PAy. As a result of this, a discharge section D[m] discharges a small amount of the ink based on the discharge waveform PAy in the corresponding unit period Tu, and forms a small dot on the recording sheets P.

In a case in which a printing signal SI[m] that is supplied in a unit period Tu shows (0, 0, 0), as shown in FIG. 15, a selection signal Sb[m] reaches an H level in the control periods TSx and TSy. In this case, a switching section TX [m] outputs a driving signal Vin [m] that is set to the reference potential V0 by selecting the driving waveform signal Com-B in the control period TSx, and outputs a driving signal Vin[m] that includes the micro vibration waveform PB by selecting the driving waveform signal Com-B in the control period TSy. Accordingly, in this case, as shown in FIG. 17, the driving signal Vin[m], which is supplied to a discharge section D[m] in the unit period Tu, includes the micro vibration waveform PB. As a result of this, a discharge section D[m] does not discharge the ink in the corresponding unit period Tu, and dots are not formed on a recording sheets P (corresponds to non-recording).

In a case in which a printing signal SI[m] that is supplied in a unit period Tu shows (0, 0, 1), as shown in FIG. 15, a selection signal Sc[m] reaches an H level in the control periods TSx and TSy. In this case, a switching section TX[m] outputs a driving signal Vin[m] that includes the detection waveform PT by selecting the driving waveform signal Com-C in the control periods TSx and TSy. Accordingly, in this case, as shown in FIG. 17, the driving signal Vin[m], which is supplied to a discharge section D[m] in the unit period Tu, includes the detection waveform PT.

In a case in which a discharge section D[m] is set as a target of the discharge state determination process in a single unit period Tu, or in other words, in a case in which a discharge section D[m] is designated as a target discharge section Dtg in a single unit period Tu, the control section 6 sets a value of a printing signal SI[m] to (0, 0, 1) so that a driving signal Vin[m], which includes the detection waveform PT, is supplied to a discharge section D[m] in the corresponding single unit period Tu.

Hereinafter, in cases in which it is particularly necessary to discriminate therebetween, there are cases in which the discharge waveform PAx and the discharge waveform PAy that are included in the driving waveform signal Com-A1 will respectively be referred to as a discharge waveform PAx1 and a discharge waveform PAy1, and in which the discharge waveform PAx and the discharge waveform PAy that are included in the driving waveform signal Com-A2 will respectively be referred to as a discharge waveform PAx2 and a discharge waveform PAy2. In addition, there are cases in which the detection waveform PT that is included in the driving waveform signal Com-C1 will be referred to as an detection waveform PT1 (an example of a "first detection waveform"), and in which the detection waveform PT that is included in the driving waveform signal Com-C2 will be referred to as an detection waveform PT2 (an example of a "second detection waveform").

Additionally, in the present embodiment, a case in which the discharge waveform PAx1 and the discharge waveform PAx2 have substantially the same shape, the discharge waveform PAy1 and the discharge waveform PAy2 have substantially the same shape, and the detection waveform PT1 and the detection waveform PT2 have substantially the same shape, is assumed. In this instance, in addition a case of being exactly the same, the term substantially the same includes a case in which manufacturing errors and errors due to noise are disregarded, and a case of being deemed as the same.

4.2 Connection Unit

Figure 18:
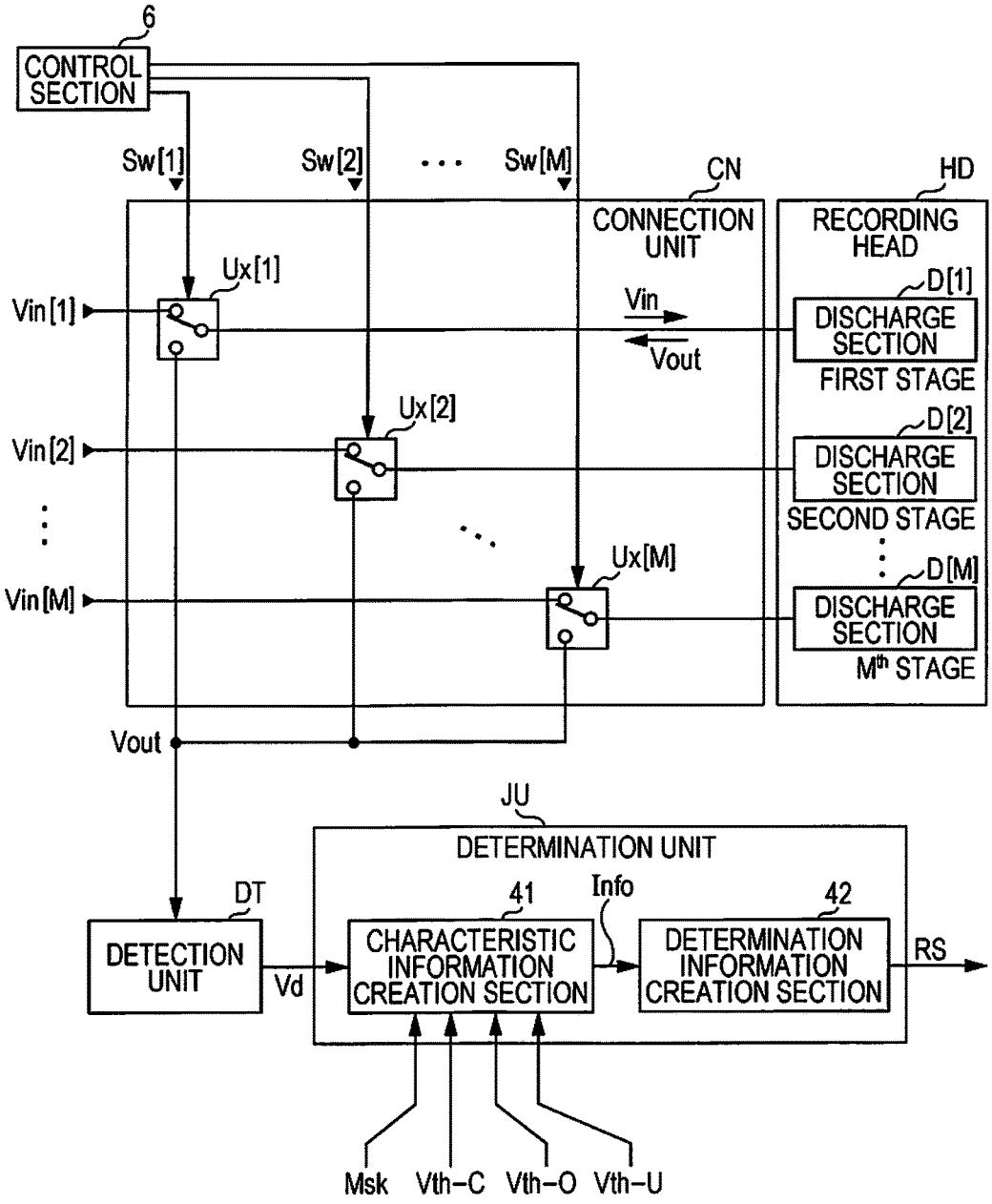
FIG. 18 is a diagram that shows a connection relationship between the recording head, a connection unit, a detection unit and a determination unit.

FIG. 18 is a diagram that shows an example of a connection relationship between a recording head HD, a connection unit CN, a detection unit DT and a determination unit JU.

As is illustrated by way of example in FIG. 18, a connection unit CN is provided with M connection circuits Ux (Ux[1], Ux[2], . . . , and Ux[M]) that correspond to the M discharge sections D on a one-to-one basis. A connection circuit Ux[m] of an $m^{th}$ stage electrically connects the upper section electrode 302 of the piezoelectric element 300 of a discharge section D[m] to either one of the output end OTN of an $m^{th}$ stage, which a creation unit GR is provided with, or a detection unit DT. Hereinafter, a state in which a connection circuit Ux[m] electrically connects a discharge section D[m] and the output end OTN of an $m^{th}$ stage of a creation unit GR will be referred to as a first connection state. In addition, a state in which a connection circuit Ux[m] electrically connects a discharge section D[m] and a detection unit DT will be referred to as a second connection state.

In a case in which the control section 6 designates a discharge section D[m] as a target discharge section Dtg in a single unit period Tu, a connection circuit Ux[m] electrically connects a discharge section DM and a detection unit DT as a result of reaching the second connection state in the detection period Td in the single unit period Tu, and electrically connects a discharge section D[m] and a creation unit GR as a result of reaching the first connection state in periods other than the detection period Td in the single unit period Tu. On the other hand, in a case in which the control section 6 does not designate a discharge section DM as a target discharge section Dtg in a single unit period Tu, a connection circuit Ux[m] electrically connects a discharge section D[m] and a creation unit GR as a result of reaching the first connection state throughout the entirety of the single unit period Tu.

The control section 6 outputs a connection control signals Sw for controlling the connection state of each connection circuit Ux, to each connection circuit Ux.

More specifically, in a case in which a discharge section D[m] is designated as a target discharge section Dtg in a single unit period Tu, the control section 6 supplies, to a connection circuit Ux[m], a connection control signal Sw[m] according to which, among the single unit period Tu, the connection circuit Ux[m] reaches the first connection state in periods other than the detection period Td, and reaches the second connection state in the detection period Td.

In addition, in a case in which a discharge section D[m] is not designated as a target discharge section Dtg in a single unit period Tu, the control section 6 supplies, to a connection circuit Ux[m], a connection control signal Sw[m] according to which the connection circuit Ux[m] retains the first connection state throughout the entirety of the single unit period Tu.

Additionally, in the present embodiment, as shown in FIG. 18, a case in which, in a single unit period Tu, each detection unit DT is only capable of detecting residual vibrations that occur in a single discharge section D, is assumed. That is, in a single unit period Tu, the control section 6 according to the present embodiment designates, for each head unit HU, a single discharge section D from among the M discharge sections D that are provided in the corresponding head unit HU as a target discharge section Dtg.

4.3. Detection Unit

In the abovementioned manner, the detection unit DT that is shown in FIG. 18 creates the shaped waveform signal Vd on the basis of the residual vibration signal Vout. In the abovementioned manner, the shaped waveform signal Vd is a signal according to which the residual vibration signal Vout is shaped into a waveform that is suitable for the process in a determination unit JU by amplifying the amplitude of the residual vibration signal Vout, and removing a noise component from the residual vibration signal Vout.

For example, a detection unit DT may have a configuration that includes a negative feedback type amplifier for amplifying the residual vibration signal Vout, a low-pass filter for dampening a high frequency component of the residual vibration signal Vout, and a voltage follower that outputs a low impedance shaped waveform signal Vd by converting the impedance thereof, or the like.

4.4. Determination Unit

The determination unit JU determines the discharge state of the ink in a discharge section D on the basis of the shaped waveform signal Vd that the detection unit DT outputs, and creates determination information RS, which shows a corresponding determination result.

As shown in FIG. 18, the determination unit JU is provided with a characteristic information creation section 41, and a determination information creation section 42.

The characteristic information creation section 41 creates characteristic information Info on the basis of the shaped waveform signal Vd. In this instance, characteristic information Info is information that shows characteristics of the residual vibrations that occur in a target discharge section Dtg, and for example, is a collective term for information such as the frequency (a duration of a single period), the amplitude and the phase of the corresponding residual vibrations. In the present embodiment, as one example, a case in which the characteristic information Info is information that is formed from period length information NTc, which shows a duration Tc of a single period of the shaped waveform signal Vd, and an amplitude flag Flag, which shows that the amplitude of the shaped waveform signal Vd has a predetermined amplitude that is required in order measures the duration Tc, is assumed. That is, in the present embodiment, the duration of a single period of the residual vibrations that occur in a target discharge section Dtg is approximately represented by the duration Tc that the period length information NTc shows.

The determination information creation section 42 determines the discharge state of the ink in a target discharge section Dtg on the basis of the characteristic information Info that the characteristic information creation section 41 creates, and outputs determination information RS that shows the corresponding determination result.

Additionally, in cases in which it is particularly necessary to discriminate therebetween, the characteristic information Info that the characteristic information creation section 41 of the determination unit Jill creates will be referred to as characteristic information Info1, and the period length information NTc, the duration Tc and the amplitude flag Flag that are included in the characteristic information Info1 will respectively be referred to as period length information NTc1, a duration Tc1 and an amplitude flag Flag1, the characteristic information Info that the characteristic information creation section 41 of the determination unit JU2 creates will be referred to as characteristic information Info2, and the period length information NTc, the duration Tc and the amplitude flag Flag that are included in the characteristic information Info2 will respectively be referred to as period length information NTc2, a duration Tc2 and an amplitude flag Flag2.

As shown in FIG. 18, in addition to the shaped waveform signal Vd, which a detection unit DT outputs, a mask signal Msk, the clock signal CL (not illustrated in FIG. 18), a threshold value potential signal that includes a threshold value potential Vth-C, which is a potential at which the shaped waveform signal Vd has an amplitude of a medium level, a threshold value potential signal that includes a threshold value potential Vth-O, which is a higher potential than the threshold value potential Vth-C, and a threshold value potential signal that includes a threshold value potential Vth-U, which is a lower potential than the threshold value potential Vth-C, are supplied to the characteristic information creation sections 41 from the control section 6.

Additionally, in cases in which it is necessary to discriminate therebetween, threshold value potentials signals that are supplied to the determination unit JU1 will be referred to as a threshold value potential Vth-C1, a threshold value potential Vth-O1 and a threshold value potential Vth-U1, and threshold value potentials signals that are supplied to the determination unit JU2 will be referred to as a threshold value potential Vth-C2, a threshold value potential Vth-O2 and a threshold value potential Vth-U2. Additionally, the details of the threshold value potential signal will be described later.

Figure 19:
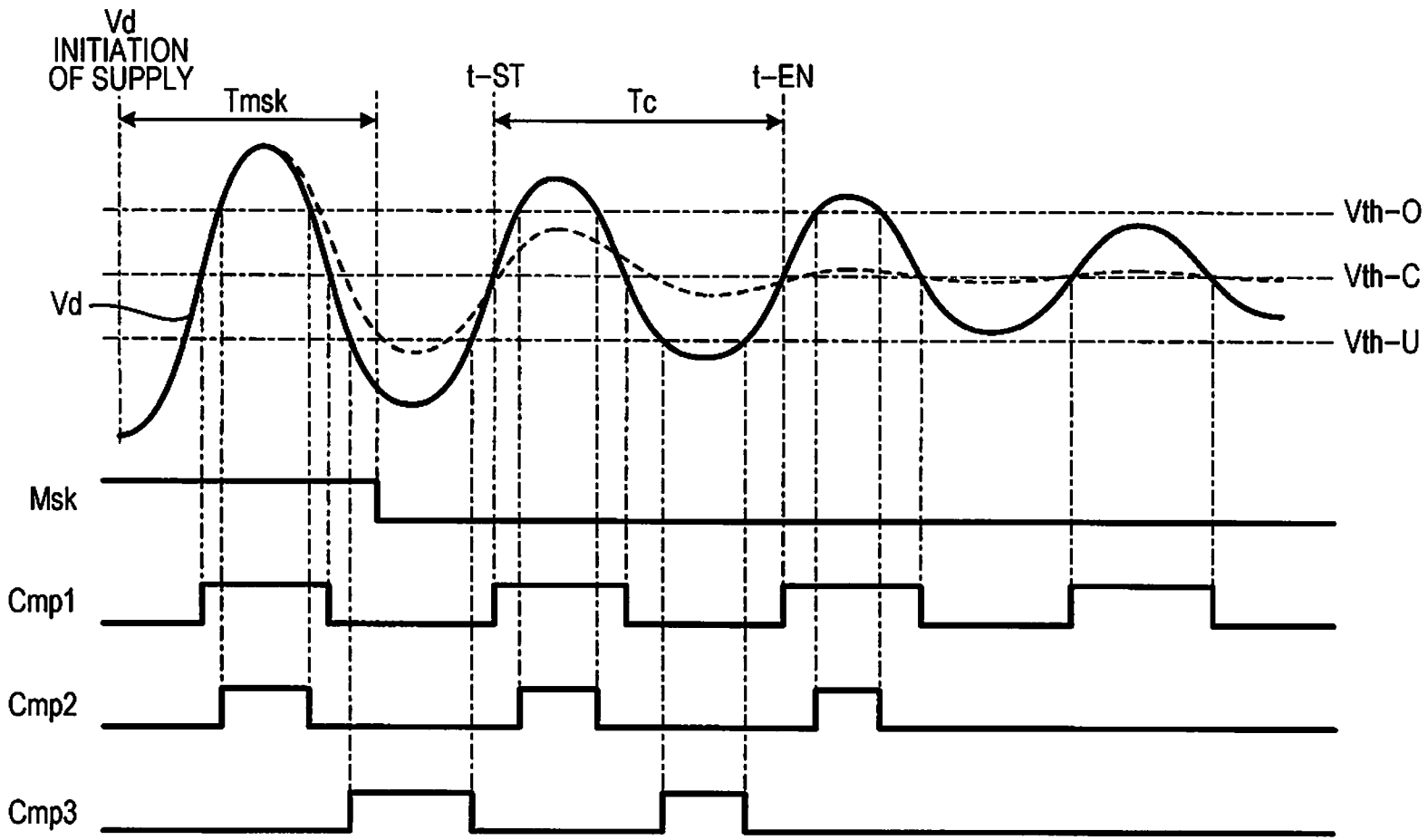
FIG. 19 is a timing chart for describing actions of a detection unit.

FIG. 19 is a timing chart that shows actions of the characteristic information creation section 41.

As shown in the drawing, a characteristic information creation section 41 creates a comparison signal Cmp1 which reaches a high level in a case in which the potential of the shaped waveform signal Vd is the threshold value potential Vth-C or more, a comparison signal Cmp2 which reaches a high level in a case in which the potential of the shaped waveform signal Vd is the threshold value potential Vth-O or more, and a comparison signal Cmp3 which reaches a high level in a case in which the potential of the shaped waveform signal Vd is less than the threshold value potential Vth-U.

The characteristic information creation section 41 is provided with a counter (not illustrated in the drawings). The counter of the characteristic information creation section 41 initiates counting of the clock signal CL at time point t-ST after the mask signal Msk falls to a low level, at which, for example, the comparison signal Cmp1 rises to a high level, ends counting of the clock signal CL at a time point t-EN, at which the comparison signal Cmp1 rises to a high level for the second time, and outputs an obtained count value as period length information NTc. That is, a count value that the period length information NTc shows the duration Tc of a single period of the shaped waveform signal Vd.

Additionally, the mask signal Msk is a signal which reaches a high level during a predetermined period Tmsk after the supply of the shaped waveform signal Vd from a detection unit DT is initiated. In the present embodiment, since characteristic information Info is acquired from a shaped waveform signal Vd after the mask signal Msk falls to a low level, it is possible to reduce the influence of a noise component that is superimposed immediately after the initiation of the residual vibrations.

Given that, in a case in which the amplitude of the shaped waveform signal Vd is small in the manner that is shown by the broken line in FIG. 19, the likelihood that it will not be possible to measure the duration Tc correctly, is increased. In addition, in a case in which the amplitude of the shaped waveform signal Vd is small, for example, the likelihood that a discharge abnormality, such as there being a state in which it is not possible to discharge the ink due to the ink not being injected into the cavity 320, will occur in a target discharge section Dtg, is increased.

In such an instance, the characteristic information creation section 41 according to the present embodiment determines whether or not the shaped waveform signal Vd has an amplitude that is required in order to measures the duration Tc or more, and creates the amplitude flag Flag, which shows the result of the corresponding determination. More specifically, the characteristic information creation section 41 sets the amplitude flag Flag to "1" in a case in which the potential of the shaped waveform signal Vd becomes the threshold value potential Vth-O or more, and becomes the threshold value potential Vth-U or less in a period from the time point t-ST to the time point t-EN, and sets the amplitude flag Flag to "0" cases other than the above.

The determination information creation section 42 that is shown in FIG. 18 determines the discharge state of the ink in a target discharge section Dtg on the basis of the characteristic information Info that the characteristic information creation section 41 outputs, and creates determination information RS that shows the corresponding determination result.

FIG. 20 is an explanatory diagram for describing the contents of the determination in the determination information creation section 42.

As is shown in FIG. 20, the determination information creation section 42 compares the period Tc, which the period length information NTc shows, with a portion of or all of a threshold value TL, a threshold value TH, and a threshold value THH.

In this instance, the threshold value TL is a value for showing a boundary between a duration of a single period of residual vibrations in a case in which the discharge state is normal, and a duration of a single period of residual vibrations in a case in which air bubble is created inside the cavity 320 and the frequency of the residual vibrations is higher than a case in which the discharge state is normal.

In addition, the threshold value TH is a value that represents a longer duration than that of the threshold value TL, and is a value for showing a boundary between a duration of a single period of residual vibrations in a case in which the discharge state is normal, and a duration of a single period of residual vibrations in a case in which foreign matter is attached to the vicinity of the outlet of the nozzle N and the frequency of the residual vibrations is lower than a case in which the discharge state is normal.

In addition, the threshold value THH is a threshold value that represents a duration that is longer than the threshold value TH, and is a value for showing a boundary between a duration of a single period of the residual vibrations in a case in which the frequency of the residual vibrations is even lower than a case in which foreign matter is attached to the vicinity of the outlet of a nozzle N due to the thickening or fixing of ink inside the cavity 320, and a duration of a single period of the residual vibrations in a case in which foreign matter is attached to the vicinity of the outlet of a nozzle N.

As shown in FIG. 20, in a case in which the value of the amplitude flag Flag is "1", and the duration Tc, which the period length information NTc shows, satisfies "TL≤Tc≤TH", the determination information creation section 42 determines that the discharge state of the ink in the target discharge section Dtg is normal, and sets a value "1", which shows that the discharge state is normal, to the determination information RS.

In addition, in a case in which the value of the amplitude flag Flag is "1", and the duration Tc, which the period length information NTc shows, satisfies "Tc<TL", the determination information creation section 42 determines that a discharge abnormality has occurred as a result of an air bubble being created in the cavity 320, and sets a value "2", which shows that a discharge abnormality has occurred due to an air bubble, to the determination information RS.

In addition, in a case in which the value of the amplitude flag Flag is "1", and the duration Tc, which the period length information NTc shows, satisfies "TH<Tc ≤THH", the determination information creation section 42 determines that a discharge abnormality has occurred as a result of foreign matter being attached to the vicinity of the outlet of a nozzle N, and sets a value "3", which shows that a discharge abnormality has occurred due to the attachment of foreign matter, to the determination information RS.

In addition, in a case in which the value of the amplitude flag Flag is "1", and the duration Tc, which shows the period length information NTc, satisfies "THH<Tc", the determination information creation section 42 determines that a discharge abnormality has occurred as a result of thickening of the ink inside the cavity 320, and sets a value "4", which shows that a discharge abnormality has occurred due to thickening of the ink, to the determination information RS.

In addition, in a case in which the value of the amplitude flag Flag is "0", the determination information creation section 42 sets a value "5", which shows that a discharge abnormality has occurred for some reason or another such as ink not being injected, to the determination information RS.

In the abovementioned manner, the determination information creation section 42 determines the discharge state in the discharge sections D on the basis of the period length information NTc and the amplitude flag Flag, and creates the determination information RS, which shows the corresponding determination result.

Additionally, in cases in which it is necessary to discriminate between the threshold values TL, the threshold values TH and the threshold values THH, the threshold values that are used in the comparison of the duration Tc1 in the determination information creation section 42 of the determination unit Jill will respectively be referred to as a threshold value TL1, a threshold value TH1 and a threshold value THH1, and the threshold values that are used in the comparison of the duration Tc2 in the determination information creation section 42 of the determination unit JU2 will respectively be referred to as a threshold value TL2, a threshold value TH2 and a threshold value THH2.

The control section 6 stores the determination information RS[m], which the determination information creation section 42 outputs, in the memory section 60 for each determination unit JU in association with a stage number m of a target discharge section Dtg that corresponds to the corresponding determination information RS[m].

In this manner, the ink jet printer 1 can determine the discharge state of ink in a discharge section D[m], and obtain determination information RS[m] that shows the corresponding determination result by executing the discharge state determination process.

Given that, the ink jet printer 1 according to the present embodiment includes the discharge section D1 that discharges the pigment ink, and the discharge sections D2 that discharge the dye inks. Further, in the present embodiment, the viscosities of the pigment ink is set to be lower than the viscosities of the dye inks. Generally, in a case in which the viscosity of the ink, with which the cavity 320 of the discharge section D is filled, is low, in comparison with a case in which the viscosity is high, the amplitude of the residual vibrations that occur in the corresponding discharge section D is high, and, in addition, the period length of the residual vibrations that occur in the corresponding discharge section D is short.

Figure 21:
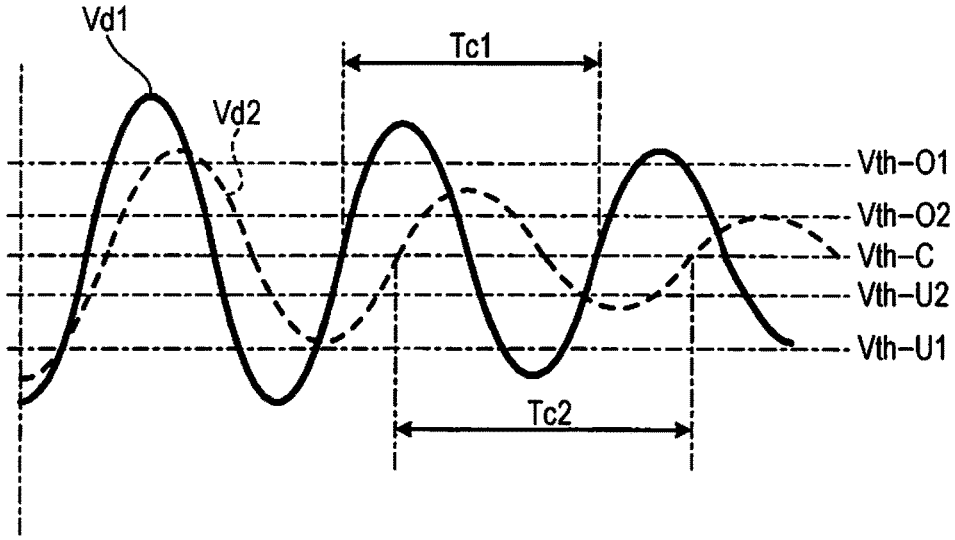
FIG. 21 is a timing chart that shows a waveform of a shaped waveform signal.

Therefore, in the manner that is illustrated by way of example in FIG. 21, in a case in which the discharge state is normal, there is a high probability that the amplitude of a shaped waveform signal Vd1, which is based on a residual vibration signal Vout1, which is detected from a discharge section D1, becomes higher than the amplitude of a shaped waveform signal Vd2, which is based on a residual vibration signal Vout2, which is detected from a discharge section D2. In addition, in the manner that is illustrated by way of example in FIG. 21, in a case in which the discharge state is normal, there is a high probability that a duration Tc1 of a single period of a waveform of a shaped waveform signal Vd1, which is based on a residual vibration signal Vout1, which is detected from a discharge section D1, is shorter than a duration Tc2 of a single period of a waveform of a shaped waveform signal Vd2, which is based on a residual vibration signal Vout2, which is detected from a discharge section D2. That is, in the present embodiment, the characteristics of the residual vibrations that occur in a discharge section D1, which discharges the pigment ink, and the characteristics of the residual vibrations that occur in a discharge section D2, which discharges a dye ink, differ even if the discharge state of the ink in both discharge sections D is normal.

In such an instance, in the present embodiment, a discharge state determination process in which a discharge section D1 is set as the target discharge section Dtg, and a discharge state determination process in which a discharge section D2 is set as the target discharge section Dtg are executed by take into consideration the difference in the characteristics of the residual vibrations that occur in a discharge section D1 and the characteristics of the residual vibrations that occur in a discharge section D2.

More specifically, in the present embodiment, firstly, the threshold value potential Vth-O1 is set as a higher potential than the threshold value potential Vth-O2, the threshold value potential Vth-C1 is set as a potential that is equivalent to the threshold value potential Vth-C2, and the threshold value potential Vth-U1 is set as a lower potential than the threshold value potential Vth-U2.

That is, in the present embodiment, in the discharge state determination process, the determination of whether or not the amplitude of a shaped waveform signal Vd1 is normal, and the determination of whether or not the amplitude of a shaped waveform signal Vd2 is normal, are executed using different criteria. Therefore, in the present embodiment, it is possible to create an amplitude flag Flag1 that correctly reflects the discharge state of a discharge section D1, and an amplitude flag Flag2 that correctly reflects the discharge state of a discharge section D2 by taking into consideration the difference in the characteristics of the residual vibrations that occur in a discharge section D1 and a discharge section D2.

In addition, in the present embodiment, each threshold value is established so that a period (an example of a "first reference period") that the threshold value TL1 shows, is a shorter period than a period (an example of a "second reference period") that the threshold value TL2 shows, so that a period (an example of a "third reference period") that the threshold value TH1 shows, is a shorter period than a period (an example of a "fourth reference period") that the threshold value TH2 shows, so that a period that the threshold value THH1 shows, is a shorter period than a period that the threshold value THH2 shows, and so that a value obtained by subtracting the threshold value TL1 from the threshold value TH1, is smaller than a value obtained by subtracting the threshold value TL2 from the threshold value TH2. In other words, each threshold value is established so as to satisfy the following Equation (1) to Equation (4).

$$TL1<TL2 \quad (1)$$

$$TH1<TH2 \quad (2)$$

$$THH1<THH2 \quad (3)$$

$$TH1-TL1<TH2-TL2 \quad (4)$$

In other words, in the present embodiment, it is determined that the discharge state of a discharge section D1 is normal in a case in which a condition (an example of a "first condition") of the duration Tc1, which shows the period length of the shaped waveform signal Vd1 that is based on the residual vibrations that are obtained from a discharge section D1, being "TL1≤Tc1≤TH1", is satisfied, and it is determined that the discharge state of a discharge section D2 is normal in a case in which a condition (an example of a "second condition") of the duration Tc2, which shows the period length of the shaped waveform signal Vd2 that is based on the residual vibrations that are obtained from a discharge section D2, being "TL2≤Tc2≤TH2", is satisfied. In other words, in the present embodiment, in the discharge state determination process, the determination (an example of a "first determination") of whether or not the duration Tc1 satisfies "TL1≤Tc1≤TH1", and the determination (an example of a "second determination") of whether or not the duration Tc2 satisfies "TL2≤Tc2≤TH2", is executed using different criteria. Therefore, in the present embodiment, it is possible to create determination information RS1 that correctly reflects the discharge state of a discharge section D1, and determination information RS2 that correctly reflects the discharge state of a discharge section D2 by taking into consideration the difference in the characteristics of the residual vibrations that occur in a discharge section D1 and a discharge section D2.

5. Conclusion of Embodiment

In the manner described above, in the present embodiment, the discharge state determination process is executed taking into consideration the characteristics of the residual vibrations that occur in a discharge section D1, which discharges the pigment ink, and the characteristics of the residual vibrations that occur in a discharge section D2, which discharges the dye inks. More specifically, the discharge state determination process is executed taking into consideration the type of ink with which a cavity 320 of a discharge section D is filled. Therefore, in comparison with a case in which a discharge state determination process is executed without taking the type of ink with which a cavity 320 of a discharge section D is filled into consideration, it is possible to suppress the occurrence of erroneous determination in the discharge state determination process, and therefore, it is possible to determine the discharge state of ink in a discharge section D with high accuracy.

In addition, in the present embodiment, since the ink jet printer 1 can discharge both the pigment ink and the dye inks, in comparison with a case in which it is only possible to discharge one of the types of ink, it is possible to perform printing of an image with a high appearance quality, an image that conforms to the needs of an end-user, and the like.

In addition, in the pigment ink, since generally, it is more likely for the viscosity to rise in accordance with the evaporation of moisture than in the dye inks, in the discharge sections D1, which discharge the pigment ink, there is a high probability that a discharge abnormality will occur due to the thickening of the ink, but in the present embodiment, since the viscosity of the pigment ink is set to be lower than the viscosity of the dye ink, in the discharge sections D1, it is possible to reduce the probability that a discharge abnormality will occur due to the thickening of ink.

In addition, in particular, in a case in which black ink having a dark color, intrudes into a region in which a chromatic color ink having a bright color, is landed, in other words, in a case in which black ink penetrates into a dot due to a chromatic color ink, color bleeding, in which the printing quality is reduced due to different colors of ink running into one another generally stands out, but in the present embodiment, since the viscosity of the black ink is lower than the viscosities of the chromatic color inks, the intrusion of black ink into dots due to chromatic color inks is prevented, and therefore, it is possible to reduce a probability that color bleeding will be recognized.

B. MODIFICATION EXAMPLES

Each of the abovementioned forms can be modified in a variety of ways. Aspects of specific modifications are illustrated by way of example below. Two or more aspects chosen arbitrarily from the following examples can be combined as appropriate within a range in which the aspects do not contradict one another. Additionally, in the modification examples that are illustrated by way of example below, the reference symbols that are referred to in the abovementioned description are reused for features for which the actions or functions thereof are equivalent to those of the embodiment, and the respective detailed descriptions thereof are omitted as appropriate.

Modification Example 1

In the above-mentioned embodiment, the threshold values TL, the threshold values TH and the threshold values THH are established so as to satisfy Equation (1) to Equation (4), but the invention is not limited to such an aspect, and the threshold values TL, the threshold values TH and the threshold values THH may be established so as to satisfy at least one of Equation (1) and Equation (2), may preferably be established so as to satisfy both Equation (1) and Equation (2), and may more preferably be established so as to satisfy Equation (1), Equation (2) and Equation (4).

Modification Example 2

In the above-mentioned embodiment and modification examples, a case in which the determination information RS can adopt five values of "1" to "5" is illustrated by way of example, but the invention is not limited to such an aspect, and the determination information RS may be determination information that can adopt at least two or more values. For example, the determination information RS may be determination information that can adopt two values of a value that shows that the discharge state in a discharge section D is normal, and a value that shows that the discharge state in a discharge section D is abnormal. In addition, for example, the determination information RS may be determination information that can adopt two values of a value that shows that the duration Tc is the threshold value TL or more, and a value that shows that the duration Tc is smaller than the threshold value TL. In addition, for example, the determination information RS may be determination information that can adopt two values of a value that shows that the duration Tc is the threshold value TH or less, and a value that shows that the duration Tc is larger than the threshold value TH.

Modification Example 3

In the above-mentioned embodiment and modification examples, the potential of the threshold value potential signal (the threshold value potentials Vth-C, Vth-O and Vth-U) differ between the discharge state determination process in which a discharge section D1 is set as a target discharge section Dtg and the discharge state determination process in which a discharge section D2 is set as a target discharge section Dtg, but the invention is not limited to such an aspect, and the potential of the threshold value potential signal need not necessarily be changed between the discharge state determination process in which a discharge section D1 is set as a target discharge section Dtg and the discharge state determination process in which a discharge section D2 is set as a target discharge section Dtg. In other words, the potential need not be changed between the threshold value potential signal that is supplied to the determination unit JU1 and the threshold value potential signal that is supplied to the determination unit JU2. In other words, the threshold value potential Vth-O1 and the threshold value potential Vth-O2 may be set to be equivalent, and the threshold value potential Vth-U1 and the threshold value potential Vth-U2 may be set to be equivalent.

In a case in which the potential is not changed between the threshold value potential signal that is supplied to the determination unit JU1 and the threshold value potential signal that is supplied to the determination unit JU2, by setting the amplification factor in the detection module 8 when the shaped waveform signal Vd2 is created from the residual vibration signal Vout2 to be greater than the amplification factor when the shaped waveform signal Vd1 is created from the residual vibration signal Vout1, the extent of a difference between the amplitude of the shaped waveform signal Vd1 and the amplitude of the shaped waveform signal Vd2 may be set to be smaller than the case of the above-mentioned embodiment.

Figure 22:
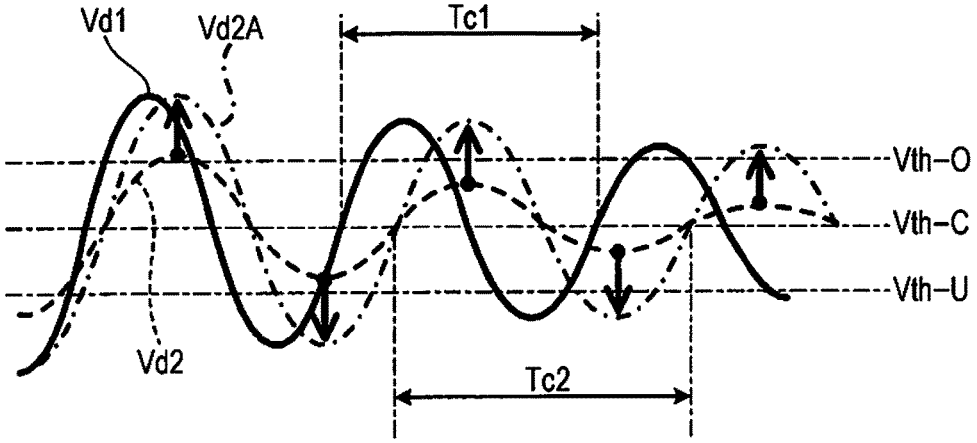
FIG. 22 is a timing chart that shows a waveform of a shaped waveform signal according to Modification Example 3.

In a case in which the potential is not changed between the threshold value potential signal that is supplied to the determination unit JU1 and the threshold value potential signal that is supplied to the determination unit JU2, as shown in FIG. 22, among the determination module 4, while characteristic information Info2 such as the amplitude flag Flag2, the duration Tc2, and the like, is created on the basis of a shaped waveform signal Vd2A after creating the corresponding shaped waveform signal Vd2A by amplifying the shaped waveform signal Vd2 in the determination unit JU2, among the determination module 4, characteristic information Info1 such as the amplitude flag Flag1, the duration Tc1, and the like, is created on the basis of the shaped waveform signal Vd1 without amplifying the shaped waveform signal Vd1 in the determination unit ail. In other words, the determination module 4 may amplify the shaped waveform signal Vd1 by a first amplification factor (one time in the example that is shown in FIG. 22) when the characteristic information Info1 for performing the first determination is created, and may amplify the shaped waveform signal Vd2 by a second amplification factor, which is larger than the first amplification factor (an amplification factor that is greater than one time in the example that is shown in FIG. 22) when the characteristic information Info2 for performing the second determination is created.

Modification Example 4

In the above-mentioned embodiment and modification examples, a case in which the driving waveform signal Com is a signal in which the discharge waveform PAx1 and the discharge waveform PAx2 have the same shape, the discharge waveform PAy1 and the discharge waveform PAy2 have the same shape, and the detection waveform PT1 and the detection waveform PT2 have the same shape, but the invention is not limited to such an aspect, and the driving waveform signal Com may be a signal that satisfies a portion of or all of the discharge waveform PAx1 and the discharge waveform PAx2 having different shapes, the discharge waveform PAy1 and the discharge waveform PAy2 having different shapes, and the detection waveform PT1 and the detection waveform PT2 having different shapes.

Figure 23:
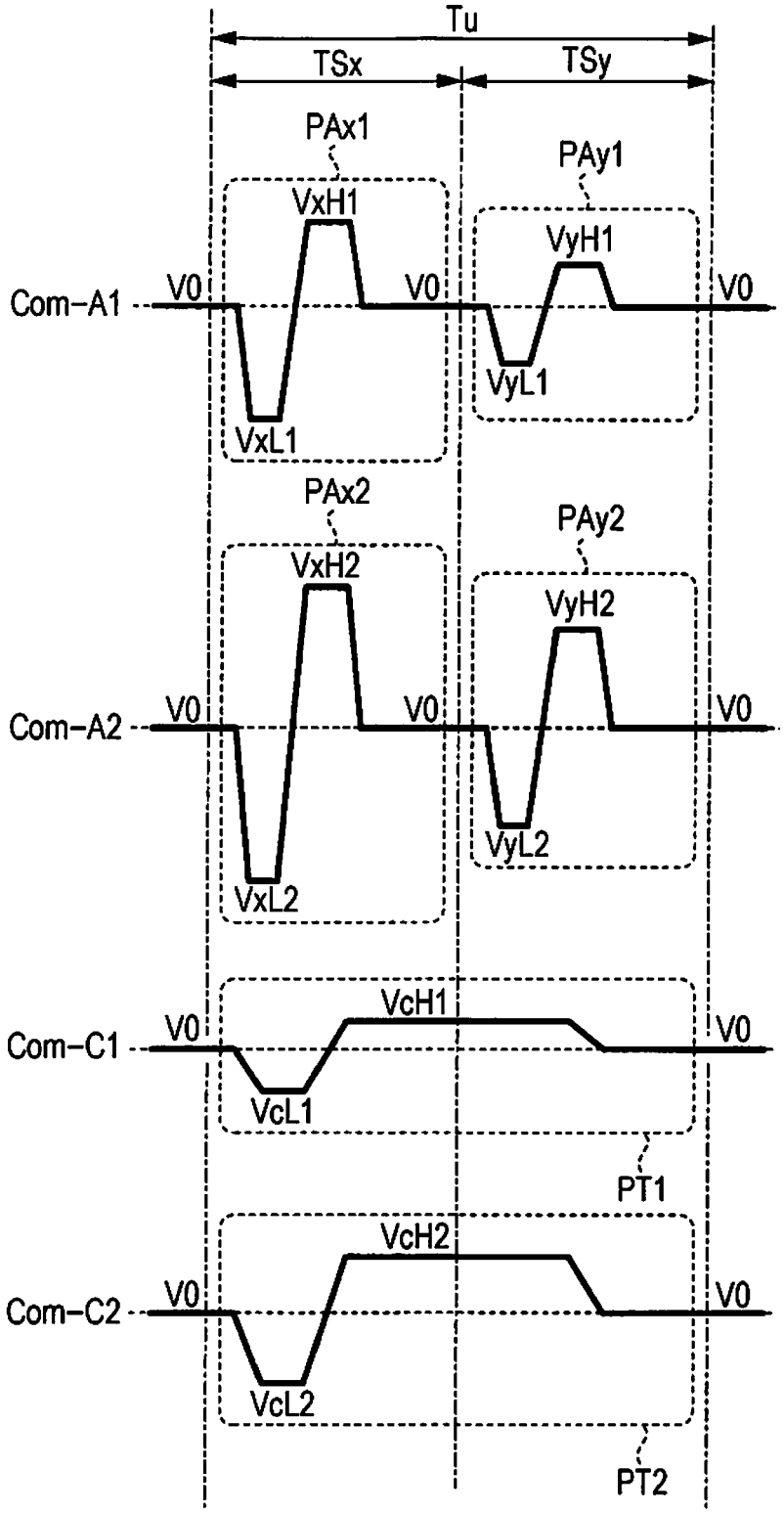
FIG. 23 is a timing chart that shows a waveform of a driving waveform signal according to Modification Example 4.

For example, as illustrated by way of example in FIG. 23, the difference in potential between the highest potential VxH1 and the lowest potential VxL1 of the discharge waveform PAx1, which the driving waveform signal Com-A1 includes, may be smaller than the difference in potential between the highest potential VxH2 and the lowest potential VxL2 of the discharge waveform PAx2, which the driving waveform signal Com-A2 includes. In the same manner, the difference in potential between the highest potential VyH1 and the lowest potential VyL1 of the discharge waveform PAy1, which the driving waveform signal Com-A1 includes, may be smaller than the difference in potential between the highest potential VyH2 and the lowest potential VyL2 of the discharge waveform PAy2, which the driving waveform signal Com-A2 includes.

In addition, for example, as illustrated by way of example in FIG. 23, the difference in potential between the highest potential VcH1 and the lowest potential VcL1 of the detection waveform PT1, which the driving waveform signal Com-C1 includes, may be smaller than the difference in potential between the highest potential VcH2 and the lowest potential VcL2 of the detection waveform PT2, which the driving waveform signal Com-C2 includes.

In addition, for example, the waveform of the driving waveform signal Com may be a waveform that differs each time the driving waveform signal Com is supplied to the head units HU, or for each type of ink that a discharge section D, to which the driving waveform signal Com is supplied as a driving signal Vin, discharges.

Modification Example 5

In the above-mentioned embodiment and modification examples, four detection units DT and four determination units JU are provided with respect to four recording heads HD, but the invention is not limited to such an aspect, and a ratio of the number of recording heads HD, the number of detection units DT and the number of determination units JU may differ from "1:1:1".

For example, the ink jet printer 1 may be a printer that is only provided with a single detection unit DT with respect to four recording heads HD.

In addition, the ink jet printer 1 may be a printer that is only provided with a single determination unit JU with respect to four recording heads HD. In this case, the number of detection units DT may be 4, or may be 1. Additionally, in a case in which both the determination of the discharge state in a discharge section D1 and the determination of the discharge state in a discharge section D2 are executed by a single determination unit JU, the potential of the threshold value potential signal, the threshold value (the threshold values TL, TH and THH) for evaluating the duration Tc, and the like, may be changed depending on the type of determination to be executed.

In addition, in the above-mentioned embodiment and modification examples, the ink jet printer 1 is provided with four head units HU to correspond to four ink cartridges 31 on a one-to-one basis, but this merely one example, and the ink jet printer 1 may be provided with at least one head unit HU or more, or the number of ink cartridges 31 and the number of head units HU may differ.

In addition, in the above-mentioned embodiment and modification examples, a head unit HU1 that is provided with a discharge section D1 is discriminated from a head unit HU2 that is provided with a discharge section D2, but the invention is not limited to such an aspect, and both a discharge section D1 and a discharge section D2 may be provided in a single head unit HU.

Modification Example 6

In the above-mentioned embodiment and modification examples, a case in which the ink jet printer 1 discharges the four colors of black, cyan, magenta and yellow is illustrated by way of example, but the invention is not limited to such an aspect, and the ink jet printer 1 may discharge at least one pigment ink and at least one dye ink.

In addition, in the above-mentioned embodiment and modification examples, black ink is illustrated as an example of a pigment ink and the three chromatic color inks are illustrated as examples of dye inks, but the invention is not limited to such an aspect, and the pigment ink and the dye ink may be any color.

Modification Example 7

The ink jet printer 1 according to the abovementioned embodiment and modification examples, is a line printer in which nozzle rows Ln are provided in a manner in which the range YNL includes the range YP, but the invention is not limited to such an aspect, and the ink jet printer 1 may be a serial printer in which the recording head HD executes a printing process by reciprocating in a Y axis direction.

Modification Example 8

In the abovementioned embodiment and modification examples, the driving waveform signal Com includes the signals of three systems of the driving waveform signals Com-A, Com-B and Com-C, but the invention is not limited to such an aspect, and it is sufficient as long as the driving waveform signal Com includes the signals of one or more systems. Therefore, for example, in a case in which the driving waveform signal Com only includes a signal of a single system, a plurality of unit periods Tu, which are action periods of the ink jet printer 1, may be classified into a unit period Tu for executing the printing process and a unit period Tu for executing the discharge state determination process, and the driving waveform signal Com may be switched in each unit period Tu, and an example of such switching includes setting the driving waveform signal Com to a waveform, such as the discharge waveform PAx, for executing the printing process in the unit period Tu for executing the printing process, and setting the driving waveform signal Com to a waveform, such as the detection waveform PT, for executing the discharge state determination process in the unit period Tu for executing the discharge state determination process.

In addition, in the above-mentioned embodiment and modification examples, the unit period Tu includes the two control periods TSx and TSy, but the invention is not limited to such an aspect, and the unit period Tu may be formed from a single control period TS, of may include three or more control periods TS.

In addition, in the abovementioned embodiment and modification examples, a printing signal SI[m] is a three bit signal, but the bit number of a printing signal SI[m] may be determined as appropriate depending on a gradation that should be displayed, the number of control period TS that are included in a unit period Tu, the number of systems of signals that are included in the driving waveform signal Com, or the like.

Modification Example 9

In the above-mentioned embodiment and modification examples, the determination information creation section 42 us mounted as an electronic circuit, but may be mounted as a functional block, which is realized as a result of the CPU of the control section 6 acting in accordance with a control program.

In the same manner, the characteristic information creation section 41 may be mounted as a functional block, which is realized as a result of the CPU of the control section 6 acting in accordance with a control program. In this case, the detection unit DT may be provided with an AD conversion circuit, and material output the shaped waveform signal Vd as a digital signal.

What is claimed is:

1. A liquid discharging apparatus comprising:

a first discharge section that discharges a pigment ink;

a second discharge section that discharges a dye ink;

a supply section that supplies a first driving signal, which drives the first discharge section, to the first discharge section, and supplies a second driving signal, which drives the second discharge section, to the second discharge section;

a detection section that detects residual vibrations that occur in the first discharge section when the supply section supplies the first driving signal, which includes a first detection waveform, to the first discharge section, and outputs a first detection signal, which shows a corresponding detection result, and detects residual vibrations that occur in the second discharge section when the supply section supplies the second driving signal, which includes a second detection waveform, to the second discharge section, and outputs a second detection signal, which shows a corresponding detection result; and a determination section that executes a first determination, which determines whether or not the first detection signal satisfies first conditions, which should be satisfied in a case in which a discharge state of the first discharge section is normal, and executes a second determination, which determines whether or not the second detection signal satisfies second conditions, which should be satisfied in a case in which a discharge state of the second discharge section is normal.

2. The liquid discharging apparatus according to claim 1, wherein the viscosity of the dye ink is greater than that of the pigment ink, wherein the first conditions include a condition that the period length of the first detection signal is a first reference period or more, wherein the second conditions include a condition that the period length of the second detection signal is a second reference period or more, and wherein the first reference period is shorter than the second reference period.

3. The liquid discharging apparatus according to claim 2, wherein the first conditions include a condition that the period length of the first detection signal is a third reference period or less, wherein the second conditions include a condition that the period length of the second detection signal is a fourth reference period or less, and wherein the third reference period is shorter than the fourth reference period.

4. The liquid discharging apparatus according to claim 3, wherein a value of a difference between the third reference period and the first reference period is smaller than a value of a difference between the fourth reference period and the second reference period.

5. The liquid discharging apparatus according to claim 1, wherein the first detection waveform and the second detection waveform are waveforms having different shapes.

6. The liquid discharging apparatus according to claim 5, wherein the viscosity of the dye ink is greater than that of the pigment ink, and wherein the amplitude of the second detection waveform is greater than the amplitude of the first detection waveform.

7. The liquid discharging apparatus according to claim 1, wherein the viscosity of the dye ink is greater than that of the pigment ink, wherein the determination section amplifies the first detection signal by a first amplification factor in a case of executing the first determination, and amplifies the second detection signal by a second amplification factor in a case of executing the second determination, and wherein the second amplification factor is greater than the first amplification factor.

8. A discharge state determination method in a liquid discharging apparatus including a first discharge section that discharges a pigment ink, a second discharge section that discharges a dye ink, a supply section that supplies a first driving signal, which drives the first discharge section, to the first discharge section, and supplies a second driving signal, which drives the second discharge section, to the second discharge section, and a detection section that detects residual vibrations that occur in the first discharge section when the supply section supplies the first driving signal, which includes a first detection waveform, to the first discharge section, and outputs a first detection signal, which shows a corresponding detection result, and detects residual vibrations that occur in the second discharge section when the supply section supplies the second driving signal, which includes a second detection waveform, to the second discharge section, and outputs a second detection signal, which shows a corresponding detection result, the method comprising:

determining whether or not the first detection signal satisfies first conditions, which should be satisfied in a case in which a discharge state of the first discharge section is normal; and determining whether or not the second detection signal satisfies second conditions, which should be satisfied in a case in which a discharge state of the second discharge section is normal.

* * * * *